US006833521B2

(12) United States Patent
Nishikawa

(10) Patent No.: US 6,833,521 B2
(45) Date of Patent: Dec. 21, 2004

(54) ROCKER SWITCH

(75) Inventor: Kikuyoshi Nishikawa, Yokohama (JP)

(73) Assignee: Sagami Electric Co., Ltd., Kanagawa (JP)

( * ) Notice: Subject to any disclaimer, the term of this patent is extended or adjusted under 35 U.S.C. 154(b) by 0 days.

(21) Appl. No.: 10/803,477

(22) Filed: Mar. 17, 2004

(65) Prior Publication Data

US 2004/0200714 A1 Oct. 14, 2004

(30) Foreign Application Priority Data

Mar. 18, 2003 (JP) ..... 2003-073588
Mar. 18, 2003 (JP) ..... 2003-073589

(51) Int. Cl.[7] ..... H01H 3/00
(52) U.S. Cl. ..... 200/339; 200/553; 200/302.3
(58) Field of Search ..... 200/339, 553, 200/302.3

(56) References Cited

U.S. PATENT DOCUMENTS 5,158,172 A * 10/1992 Roeser et al. ..... 200/553
5,660,270 A * 8/1997 Martin et al. ..... 200/315
5,662,213 A * 9/1997 Kattler et al. ..... 200/302.3
5,896,768 A * 4/1999 Cranick et al. ..... 70/264
6,103,982 A * 8/2000 Chien ..... 200/315
6,388,221 B1 * 5/2002 Rudolph et al. ..... 200/556
6,600,122 B1 * 7/2003 Czarnecki et al. ..... 200/553

FOREIGN PATENT DOCUMENTS

JP 3224949 of 0000
JP 5-1870 1/1993
JP 6035333 of 1994
JP 0855542 2/1996
JP 01195955 7/2001

* cited by examiner

*Primary Examiner*—Kyung Lee
(74) *Attorney, Agent, or Firm*—David N. Lathrop, Esq.; Gallagher & Lathrop

(57) ABSTRACT

A movable contact is mounted on the vicinity of one end of a movable contact piece having a generally U-like shape and made of an elastic member. A recess of a generally circular arc-shape in section is formed on the vicinity of the other end of the movable contact piece to extend in the direction of the width thereof. The movable contact piece is swingably supported by the movable contact piece support member, and a generally circular arc-shaped tip in section of a movable contact piece actuator of an operation button is engaged with the recess. The movable contact piece actuator swingable with the swinging movement of the operation button causes the movable contact piece to be swung to the switch-on position where the movable contact thereof comes into contact with a fixed contact mounted on a fixed contact piece or the switch-off position where the movable contact is away from the fixed contact. The movable contact piece actuator and the movable contact piece operate as if they are linked, and the movable contact piece swings by the rolling friction. Accordingly, feeling in actuation of the operation button becomes much favorable, the operation of the rocker switch is stable, and more quick reverse operation of the movable contact piece is ensured.

12 Claims, 14 Drawing Sheets

ROCKER SWITCH

BACKGROUND OF THE INVENTION

1. Field of the Invention

The present invention relates to an improvement in a rocker switch that is used in various kinds of OA (office automation) machines or equipments, amusement and game machines, measurement instruments, medical instruments and the like.

2. Description of the Related Art

A rocker switch (also called a seesaw switch due to its mechanism) is used, for example, as a power switch in various kinds of OA machines, amusement and game machines, measurement instruments, medical instruments and the like. In general, the rocker switch is constructed such that its switch components or parts are housed in a square or rectangular box (casing) the top of which is open and an operation button (operation knob) is mounted at the opening space of the box at the top thereof such that it can be moved for seesaw movement.

Various types of rocker switches having their constructions or structures different from one another have been heretofore proposed, and the present invention relates to an improvement in a rocker switch of the type in which a movable contact piece is made of an elastic or resilient member and is mounted on a movable contact piece support member such that it can move for swinging or rocking movement; a terminal portion (tab terminal) of the movable contact piece support member is led out to the outside of a box through a corresponding slit formed through the bottom wall of the box; a terminal portion (tab terminal) of a fixed contact piece is led out to the outside of the box through a corresponding slit formed through the bottom wall of the box; an actuator for actuating the movable contact piece is integrally formed on an operation button or knob and extends downwardly therefrom; and when the operation button is operated for rocking operation, the movable contact piece actuator is moved for rocking operation together with the operation button thereby to actuate the movable contact piece so that it is moved to one position where a movable contact mounted thereto is brought into contact with a fixed contact mounted to the fixed contact piece or the other position where the movable contact is spaced apart from the fixed contact.

Rocker switches of this type have been also proposed in the past, and a seesaw switch is disclosed in, for example, Japanese Examined Utility Model Application Publication No. 05-001870 (JP, 05-001870, Y(1993)) published on Jan. 19, 1993, in which a large contact pressure can be applied between a movable contact and a fixed contact. In Japanese Examined Utility Model Application Publication No. 06-035333 (JP, 06-035333, Y(1994)) published on Sep. 14, 1994, there is disclosed a terminal fixing structure for a seesaw switch in which there are no possibility that a bad or poor contact or a joining between contacts by fusion occurs. In Japanese Unexamined Patent Application Publication No. 08-055542 (JP, 08-055542, A(1996)) published on Feb. 27, 1996, there is disclosed a seesaw switch in which if a movable contact and a fixed contact should be joined with each other by fusion, it is ensured that these contacts can be securely opened or released from each other, but a compression coil spring is used as a movable contact actuator. In Japanese Unexamined Patent Application Publication No. 2001-195955 (JP, 2001-195955, A) published on Jul. 19, 2001, a seesaw switch having a dustproof structure is disclosed, but a compression coil spring is used as a movable contact actuator. In Japanese Patent No. 3224949 (JP, 3224949, B) issued on Nov. 5, 2001, there is disclosed a terminal fixing structure of a seesaw switch using a clinching or fastening technique in which a displacement in position of a terminal and/or a displacement in position of a contact is hard to occur when a terminal is fixed by use of a clinching or fastening technique, but a combination or assembly of a torsion coil spring and a movable contact piece is used.

The prior art rocker switches disclosed in the above-stated documents have disadvantages that it is not easy to build or assemble a terminal portion of a movable contact piece support member and a terminal portion of a fixed contact piece in a box and to fix them thereto, and that there sometimes occurs a case that the terminal portion or portions of the movable contact piece support member and/or of the fixed contact piece are securely not fixed to the box. Moreover, there is a drawback that when an operation button is operated, there cannot be obtained actual feeling that the operation button swings lightly and smoothly (without feeling a resistance thereto) as well as that the operation button has positively stopped at its on position or off position, that is, feeling in actuation of the operation button is bad or unfavorable.

In addition, there is a problem in that a movable contact piece is rapidly swung, and since a stable reverse operation thereof cannot be obtained, it is difficult to reduce a bounce time in throwing the movable contact piece to its on position. Furthermore, it is also difficult to make smaller an arc that occurs when the movable contact piece is thrown to its off position.

It is necessary to prevent a trouble or accident that a displacement in position of a movable contact piece occurs or a movable contact piece gets out of place due to an external shock from occurring. However, in the prior art rocker switches disclosed in the above-stated documents, there is not provided means for preventing such trouble or accident from occurring without fail.

Moreover, since it is impossible to prevent an arc that occurs between a movable contact piece and a movable contact piece support member due to a bounce of the movable contact piece in turning a rocker switch on or off, there is a defect that a lifetime of the switch is shortened.

Further, TAB 187 terminal of IEC (International Electrotechnical Commission) standard is used as a terminal portion (tab terminal) of a rocker switch of rated current 10A type, and it is necessary that TAB 250 terminal of IEC standard is used as a terminal portion (tab terminal) of a rocker switch of rated current 16A type. The width of TAB 187 terminal is 4.75 mm, while the width of TAB 250 terminal is 6.35 mm. Therefore, the width of TAB 250 terminal is wider by 1.6 mm than that of TAB 187 terminal. For example, in some machine or apparatus having a rocker switch of rated current 10A type mounted thereon, if the user therefor wishes to use a rocker switch of rated current 16A type in place of the rocker switch of rated current 10A type, the machine or apparatus must have a space in which the rocker switch of rated current 16A type can be accommodated at a location that the rocker switch of rated current 10A type has been now mounted, because the external sizes (width and depth) of a box of the rocker switch of rated current 16A type are necessarily larger than those of a box of the rocker switch of rated current 10A type. If the machine or apparatus should not have a space in which a rocker switch having its external width and depth larger than those of the rocker switch of rated current 10A type can be accommodated, it is impossible to use the rocker switch of rated current 16A type in that machine or apparatus.

In recent years, various kinds of OA machines or equipments, amusement and game machines, measurement instruments, medical instruments and the like are showing a tendency to be miniaturized more and more, and hence there is a strong demand for the advent of a miniature rocker switch that has larger rated current/voltage value as well as can be accommodated in a small space.

SUMMARY OF THE INVENTION

An object of the present invention is to provide a rocker switch in which components thereof can easily be built or assembled in a box and fixed thereto, and yet, a rapid reverse operation as well as favorable and excellent feeling in actuation of an operation button when it is operated, can be obtained.

Another object of the present invention is to provide a rocker switch in which favorable and excellent feeling in actuation of an operation button when it is operated, can be obtained, and yet, there occurs no trouble or accident that a displacement in position of a movable contact piece occurs or a movable contact piece gets out of place due to an external shock.

Another object of the present invention is to provide a rocker switch in which favorable and excellent feeling in actuation of an operation button when it is operated, can be obtained, and yet, no arc occurs at all between a movable contact piece and a movable contact piece support member due to a bounce of the movable contact piece.

Still another object of the present invention is to provide a rocker switch of a predetermined rated current/voltage that can be used as another rocker switch of rated current/voltage larger than the predetermined rated current/voltage without increasing the external sizes thereof.

In order to accomplish the foregoing objects, in one aspect of the present invention, there is provided a rocker switch comprising: a movable contact piece having a generally U-like shape, that is made of an elastic member; a movable contact that is mounted on a portion of the movable contact piece near one end thereof; a movable contact piece support member that comprises: a movable contact piece support for swingably supporting the movable contact piece; and a tab terminal hanging down from the movable contact piece support; a pair of detents that is formed to project on the both side edges of the tab terminal of the movable contact piece support member in the direction of the width of the tab terminal at predetermined positions thereof; a fixed contact piece that comprises: a fixed contact support on which a fixed contact is mounted; and a tab terminal hanging down from the fixed contact support; a pair of detents that is formed to project on the both side edges of the tab terminal of the fixed contact piece in the direction of the width of the tab terminal at predetermined positions thereof; a box that has its top opened and a slit formed through the bottom wall of the box, through which the tab terminal of the movable contact piece support member is pulled out toward the outside and a slit formed through the bottom wall of the box, through which the tab terminal of the fixed contact piece is pulled out toward the outside; an operation button that comprises a movable contact piece actuator to be engaged with the movable contact piece and is swingably mounted to the opening portion of the box; and a recess that is formed on a portion of the movable contact piece near the other end thereof to extend in the direction of the width of the movable contact piece and has a generally circular arc-shape in section engaged with a generally circular arc-shaped tip in section of the movable contact piece actuator of the operation button, and wherein the movable contact piece support member is engaged and secured on the bottom wall of the box by forcedly bending a pair of the detent pieces of the tab terminal thereof outwardly in the direction of the width thereof and engaging them, the tab terminal being pulled out toward the outside through the corresponding slit formed through the bottom wall of the box; the fixed contact piece is engaged and secured on the bottom wall of the box by forcedly bending a pair of the detent pieces of the tab terminal thereof outwardly in the direction of the width thereof and engaging them, the tab terminal being pulled out toward the outside through the corresponding slit formed through the bottom wall of the box; the operation button is swingably mounted to the opening portion of the box in the state that the generally circular arc-shaped tip in section of the movable contact piece actuator is engaged with the recess of a generally circular arc-shape in section of the movable contact piece; and the movable contact piece actuator that is swingable with the swinging movement of the operation button causes the movable contact piece to be swung to the switch-on position where the movable contact thereof comes into contact with the fixed contact or the switch-off position where the movable contact thereof is away from the fixed contact.

In a first preferred embodiment, the operation button further includes a rod-like member projecting beyond the tip of the movable contact piece actuator. The movable contact piece has an elongate aperture at a portion thereof near the recess, into which the forward end of the rod-like member of the operation button is inserted with a clearance or play therebetween. The forward end of the rod-like member is inserted into the elongate aperture with a clearance or play therebetween when the operation button is swingably mounted to the opening portion of the box.

In a second preferred embodiment, the box has a generally rectangular or square shape in plan, and a partition wall that isolates the tab terminal of the movable contact piece support member and the tab terminal of the fixed contact piece from each other, is formed on the bottom surface of the bottom wall of the box. The length of the partition wall is set to be substantially equal to those of the tab terminals, and the slits are formed obliquely in the bottom wall of the box from the vicinities of the corners thereof to form a predetermined angle with one side of the bottom wall respectively.

In a third preferred embodiment, the rocker switch further includes a conductive resilient piece that is swingably mounted on the movable contact piece support member. The conductive resilient piece is located, when the movable contact piece is swingably mounted on the movable contact piece support member, between the movable contact piece and the movable contact piece support member and is in electrically contact with both the movable contact piece support member and the movable contact piece.

The conductive resilient piece comprises: a sheet-like resilient piece body; a pair of opposed retentive pieces that substantially stand erect from the resilient piece body; and at least one pair of opposed protrusions that project outwardly and upwardly from the resilient piece body in the direction of forming generally right angles with a line connecting the retentive pieces. A pair of the retentive pieces is pressed and abutted against the movable contact piece support member when the movable contact piece is swingably mounted on the movable contact piece support member, and at least one pair of the protrusions is pressed and abutted against the movable contact piece when the movable contact piece is swingably mounted on the movable contact piece support member through the resilient piece therebetween.

With the construction described above, it is possible to mount or assemble the fixed contact piece and the movable contact piece support member in the box and to secure them simply and easily with accuracy and stability. In addition, engagement between each movable contact piece actuator of the operation button and the movable contact piece is in the rolling friction state. As a result, there can be obtained actual feeling that the operation button swings lightly and smoothly as well as that the operation button has positively stopped at its switch-on position or switch-off position, and feeling in actuation of the operation button comes to much favorable or excellent. Furthermore, the quick swinging operation of the movable contact piece is made possible and the more stable reverse operation of the movable contact pieces is obtained. Accordingly, a bounce time in throwing the movable contact piece to its switch-on position can be much more reduced and an arc occurring in throwing the movable contact piece to its switch-off position can also be made smaller. As a result, wear and tear of the contacts are further restrained and there can be provided the contacts the lifetime of which is much more longer.

In addition, in accordance with the first embodiment, since the rod-like member of the movable contact piece actuator of the operation button is inserted into the elongate aperture of the movable contact pieces with a clearance between the rod-like member and the periphery of the elongate aperture, it is ensured that there occurs no trouble or accident that a displacement in position of the movable contact piece occurs or the movable contact piece falls off due to an external shock, and hence it is possible to make the operation of the rocker switch stable.

In accordance with the second embodiment, since a rocker switch of a predetermined rated current/voltage can be used as another rocker switch of rated current/voltage larger than the predetermined rated current/voltage without increasing the external sizes of the box, OA machines or equipments, amusement and game machines, measurement instruments, medical instruments and the like, for example, can be modified to ones each having larger rated current/voltage value without increasing sizes thereof.

In accordance with the third embodiment, since no arc occurs between the movable contact piece and the movable contact piece support piece due to a bounce occurring on turning the rocker switch on or off, a lifetime of these components are greatly lengthened.

DETAILED DESCRIPTION OF THE PREFERRED EMBODIMENTS

The preferred embodiments of the present invention will now be described in detail with reference to the accompanying drawings. The present invention may, however, be embodied in many different forms and should not be construed as limited to the embodiments set forth hereinafter; rather, the embodiments are provided so that this disclosure will be thorough and complete, and will fully convey the scope of the invention to those skilled in the art.

At first, there will be described a first embodiment of the rocker switch according to the present invention in detail with reference to FIGS. 1 to 23.

Figure 1:
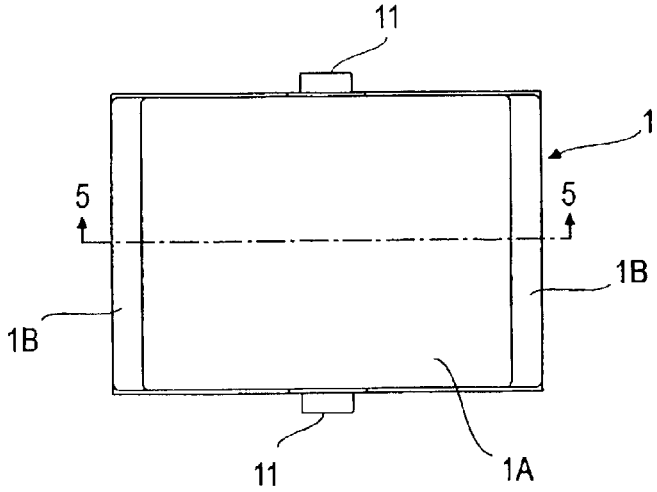
FIG. 1 is a plan view showing an operation button used in a first embodiment of the rocker switch according to the present invention.
Figure 2:
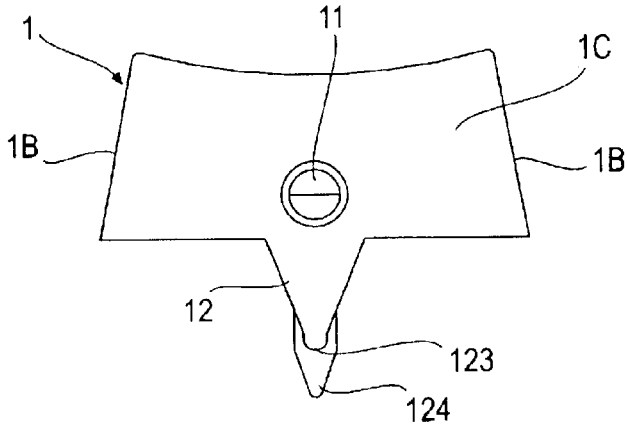
FIG. 2 is a side view of FIG. 1 as viewed from below.
Figure 3:
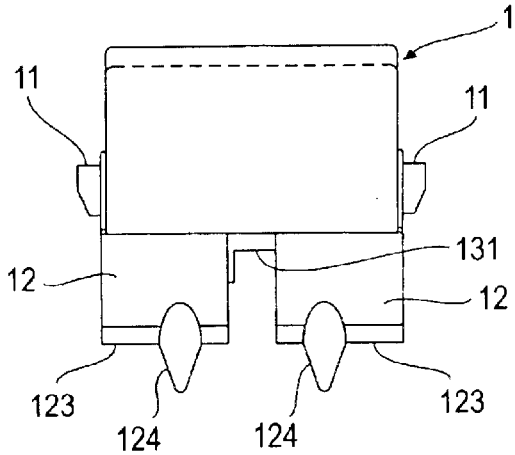
FIG. 3 is a right-hand side view of FIG. 1.
Figure 4:
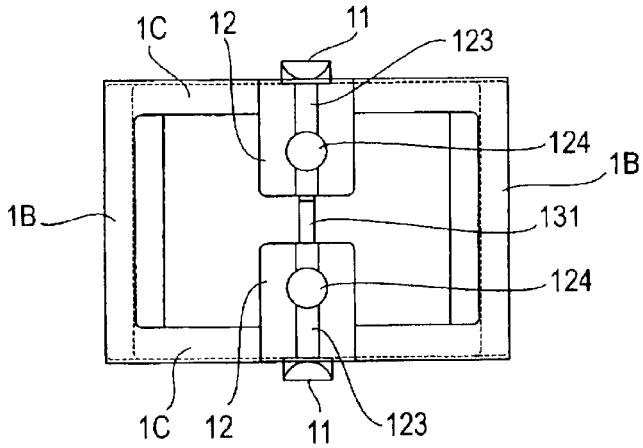
FIG. 4 is a bottom view of FIG. 1.
Figure 5:
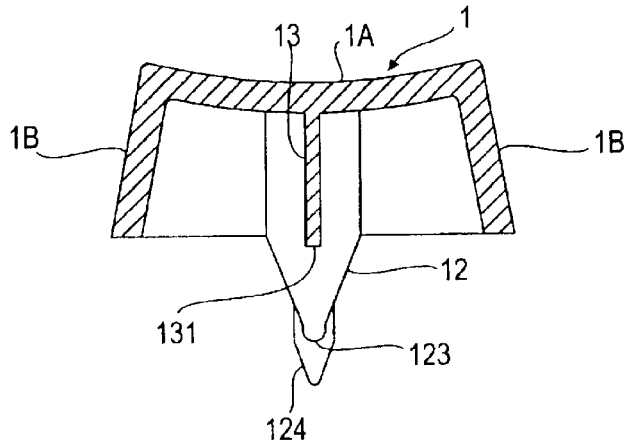
FIG. 5 is a sectional view taken along the line 5—5 in FIG. 1 and looking in the direction indicated by the arrows.

FIGS. 1-5 show an operation button (operation knob) used in the first embodiment of the rocker switch, and FIG. 1 is a plan view of the operation button, FIG. 2 is a side view of FIG. 1 as viewed from below, FIG. 3 is a right-hand side view of FIG. 1, FIG. 4 is a bottom view of FIG. 1, and FIG. 5 is a sectional view taken along the line 5—5 in FIG. 1 and looking in the direction indicated by the arrows. The operation button 1 comprises: a top wall 1A having a generally rectangular shape in plan as shown in FIG. 1; a pair of side walls (hereinafter, each referred to as minor side wall) 1B, 1B hanging down obliquely from opposed edges of minor sides of the top wall 1A, respectively, as shown FIGS. 2, 4 and 5; and a pair of side walls (hereinafter, each referred to as major side wall) 1C, 1C hanging down substantially vertically from opposed edges of major sides of the top wall 1A, respectively, as shown FIGS. 2 and 4. As is apparent from FIGS. 2 and 5, the top wall 1A is formed in a concave in its longitudinal direction, and each major side wall 1C has its wall surface of a generally isosceles trapezoid as is clear from FIG. 2. Each minor side wall 1B has its wall surface of a generally rectangle as is clear from FIG. 3.

On each of the major side walls 1C at the central portion in longitudinal direction thereof near the bottom side is formed a rotatable shaft 11 projecting outwardly from the major side wall 1C at substantially right angles therewith. The rotatable shafts 11 on both the major side walls 1C are aligned with each other. As is clear from FIGS. 4 and 5, a pair of rectangular pillar-shaped movable contact piece actuators 12, 12 each having a generally rectangular shape in cross section are formed integrally with the underneath surface of the top wall 1A and with the corresponding one of the major side walls 1B. These movable contact piece actuators 12 are formed, in this embodiment, along a straight line connecting between the rotatable shafts 11, and portions of the movable contact piece actuators 12 that hang down from the bottom of the operation button 1 are tapered in their major-side walls opposed to each other, as is apparent from FIGS. 2, 3 and 5. In addition, the tip 123 of each of the movable contact piece actuators 12 are formed to have a generally circular arc shape, as is clear from FIGS. 2 and 5.

On the underneath surface of the top wall 1A is formed integrally therewith a plate-like wall 13 that hangs down from its central portion in the longitudinal direction thereof. This wall 13 is formed between the opposed side surfaces of the movable contact piece actuators 12 that are joined and united through the wall 13. As is apparent from FIGS. 3 and 5, the wall 13 projects downwardly by a predetermined distance from the bottom of the operation button 1, and the forward end portion 131 thereof is shortened in a part thereof opposite to a partition wall 21 of a box 2 (see FIGS. 6-12) described later so that the forward end portion 131 cannot come into contact with the top of the partition wall.

As is clear from FIGS. 3-5, a rod 124 formed into a generally conical shape is formed integrally with each movable contact piece actuator 12, each rod 124 projecting downwardly from a predetermined position near the forward end 123 of the corresponding movable contact piece actuator 12 beyond the forward end 123.

Figure 6:
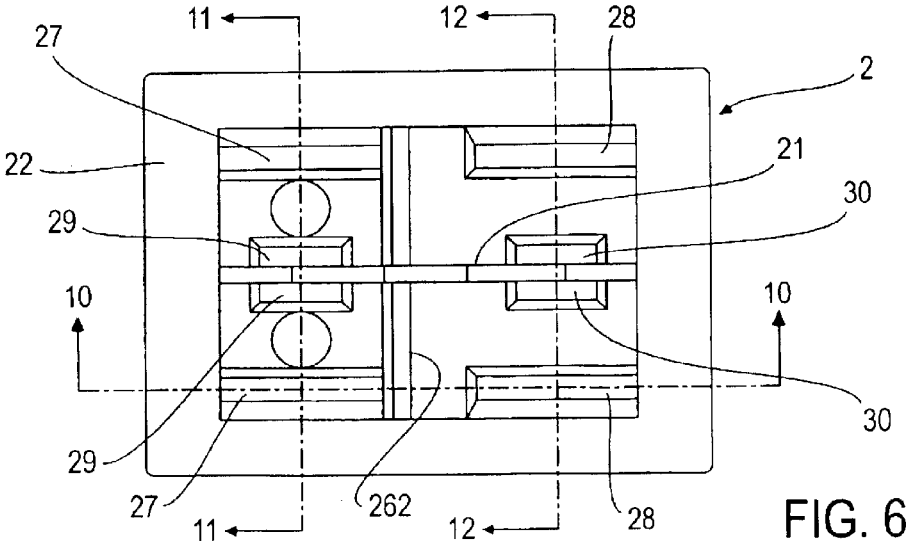
FIG. 6 is a plan view showing a box used in a first embodiment of the rocker switch according to the present invention.
Figure 7:
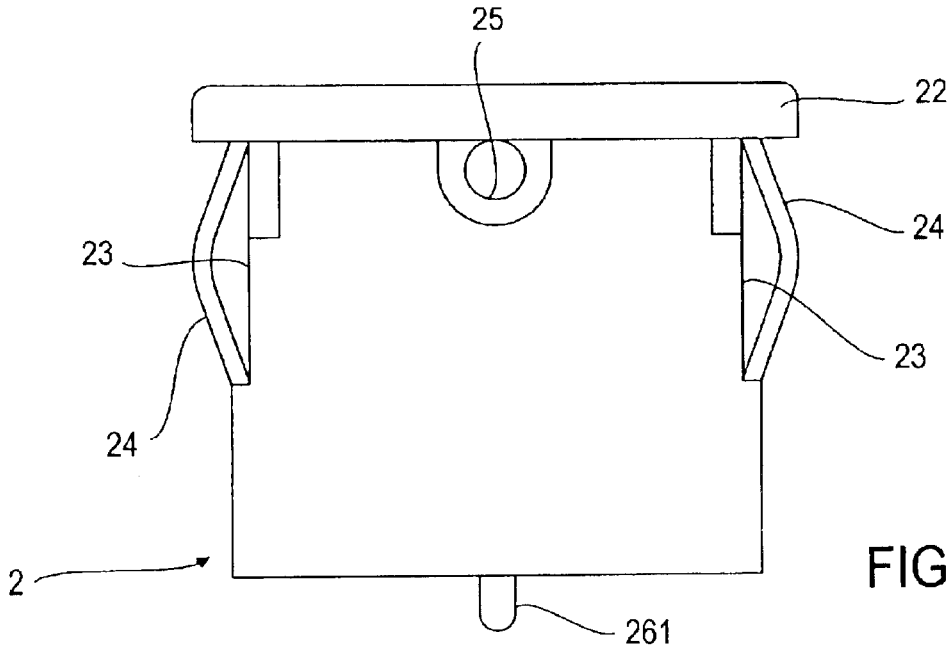
FIG. 7 is a side view of FIG. 6 as viewed from below.
Figure 8:
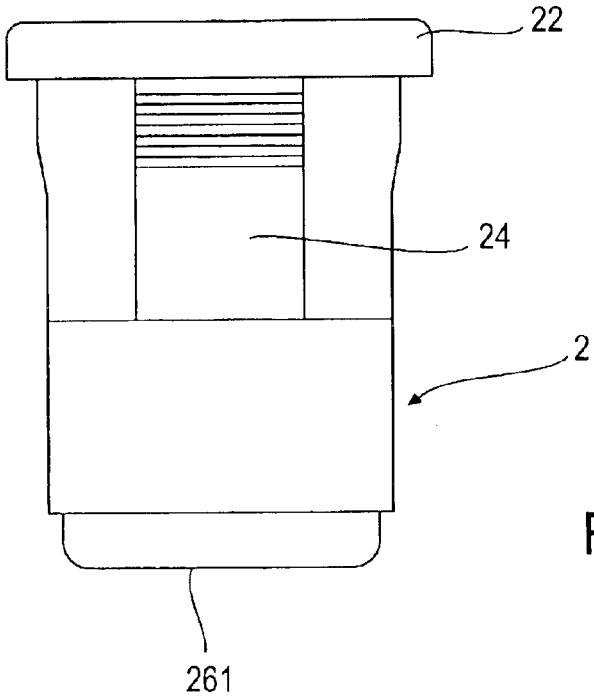
FIG. 8 is a right-hand side view of FIG. 6.
Figure 9:
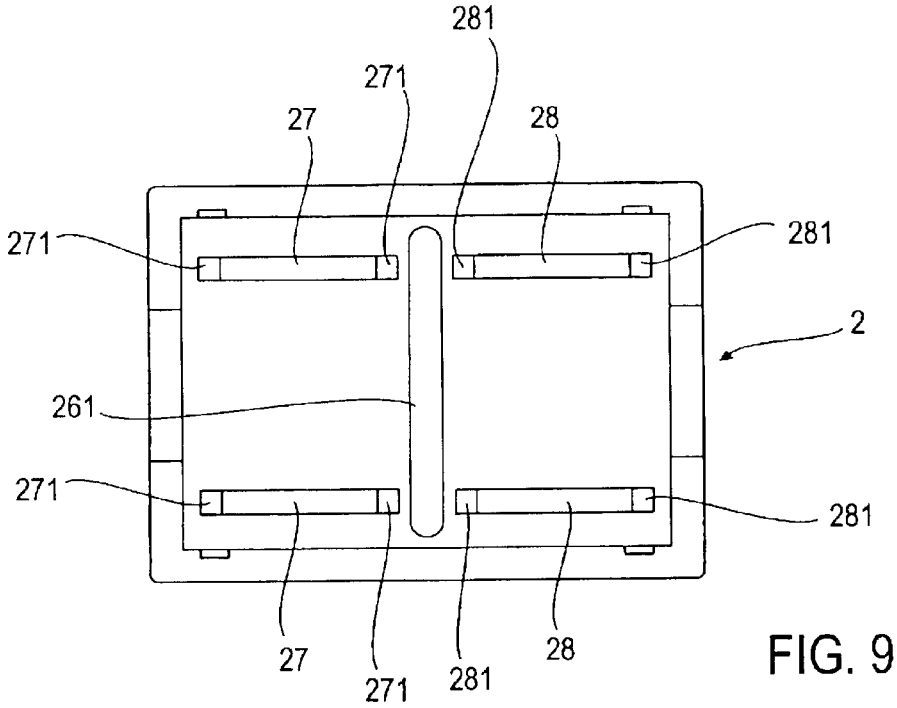
FIG. 9 is a bottom view of FIG. 6.
Figure 10:
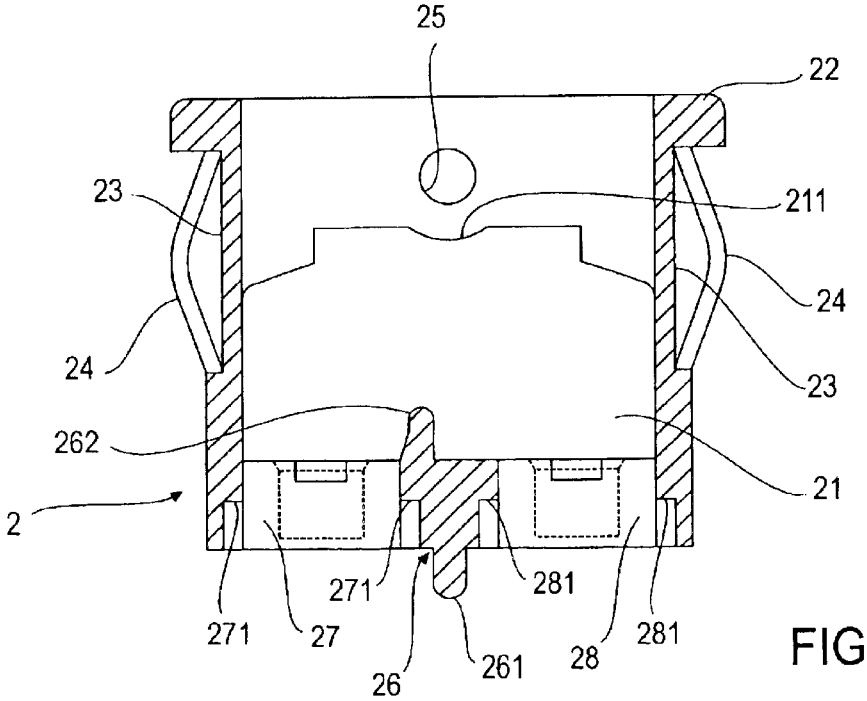
FIG. 10 is a sectional view taken along the line 10—10 in FIG. 6 and looking in the direction indicated by the arrows.
Figure 11:
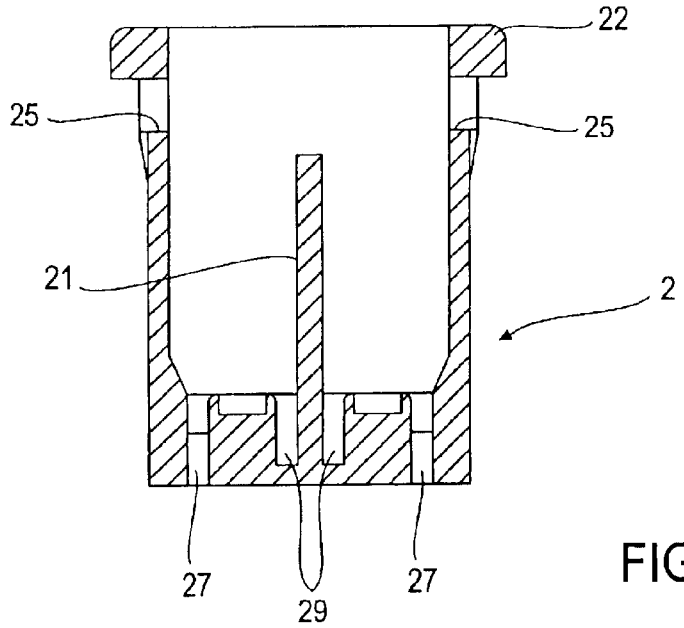
FIG. 11 is a sectional view taken along the line 11—11 in FIG. 6 and looking in the direction indicated by the arrows.
Figure 12:
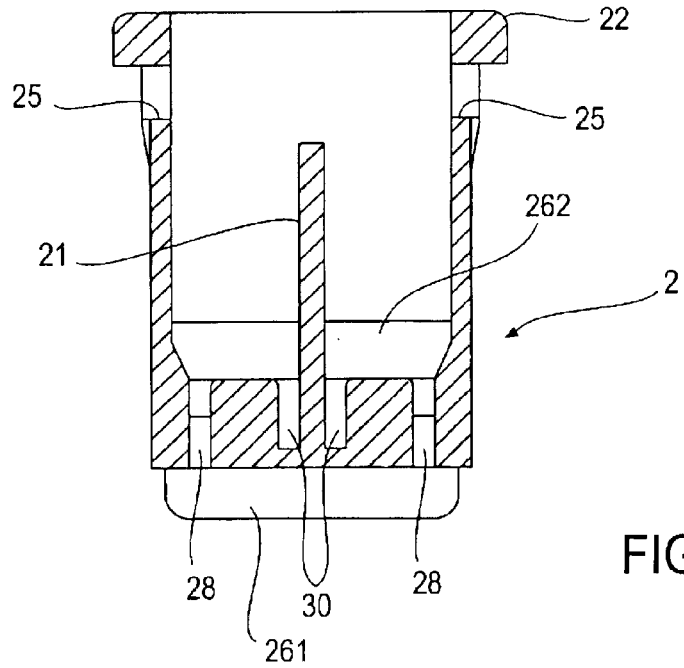
FIG. 12 is a sectional view taken along the line 12—12 in FIG. 6 and looking in the direction indicated by the arrows.

FIGS. 6 to 12 show a box (casing) used in the first embodiment of the rocker switch, and FIG. 6 is a plan view showing the box, FIG. 7 is a side view of FIG. 6 as viewed from below, FIG. 8 is a right-hand side view of FIG. 6, FIG. 9 is a bottom view of FIG. 6, FIG. 10 is a sectional view taken along the line 10—10 in FIG. 6 and looking in the direction indicated by the arrows, FIG. 11 is a sectional view taken along the line 11—11 in FIG. 6 and looking in the direction indicated by the arrows, and FIG. 12 is a sectional view taken along the line 12—12 in FIG. 6 and looking in the direction indicated by the arrows. This box 2 is a rectangular box the top of which is open and having a generally rectangular shape in plan, and the partition wall 21 is formed in the box 2 at the central portion thereof along the longitudinal direction of the box 2, the partition wall 21 dividing the interior of the box 2 into two substantially same rooms. Since the rocker switch of this embodiment is a double pole-single throw (DPST) switch, there are required two rooms in which two sets of switch components or parts are accommodated respectively. For this reason, the interior of the box 2 is partitioned into two rooms by the partition wall 21. However, in case of a single pole-single throw (SPST) switch, the interior of the box 2 may not be partitioned into two rooms. The partition wall 21 has a circular arc reentrancy 211 formed in the center of the top end portion thereof as is apparent from FIG. 10. This reentrancy 211 is provided to prevent the top end portion of the partition wall 21 from coming into contact with the forward end portion 131 of the wall 13 of the operation button 1 constructed as described above, when the operation button 1 is mounted to the opening of the box 2 for seesaw movement. Further, it may be constructed that the reentrancy 211 is not provided in the partition wall 21 by lowering the height of the partition wall 21 by a little.

A flange 22 having a generally rectangular shape is formed integrally with the opening portion of the box 2, and recesses 23 for mounting leaf springs are formed in a pair of opposed minor side walls of the box 2, each recess 23 extending downwardly from a wall portion immediately below the flange 22 by a predetermined length. Leaf springs 24 each being curved outwardly are mounted in the corresponding recesses 23, respectively. In addition, in a pair of opposed major side walls of the box 2 at the central portions thereof immediately below the flange 22 are formed through holes (bearing apertures) 25 for rotatably supporting the corresponding rotatable shafts 11 of the operation button 1. These through holes 25 are situated on a straight line that is substantially at right angles to the surfaces of the major side walls.

Figure 13:
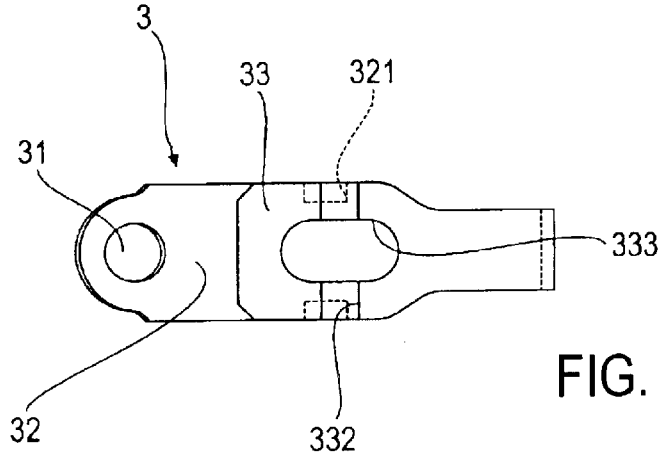
FIG. 13 is a plan view showing a movable contact piece used in a first embodiment of the rocker switch according to the present invention.
Figure 14:
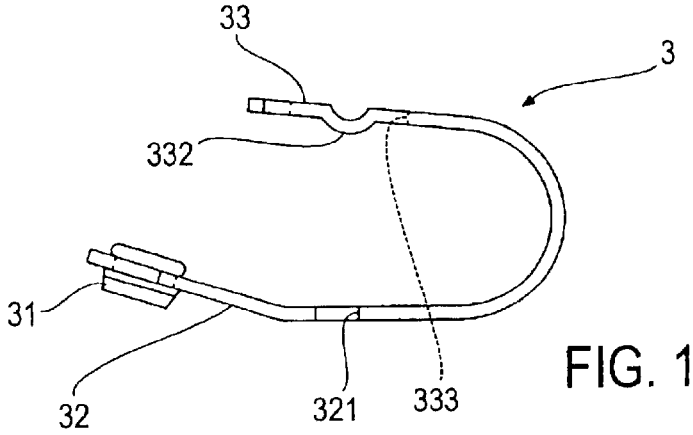
FIG. 14 is a side view of FIG. 13 as viewed from below.
Figure 15:
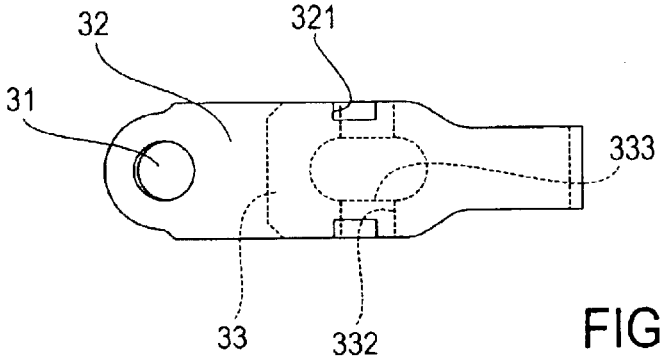
FIG. 15 is a bottom view of FIG. 13.

FIGS. 13 to 15 show a movable contact piece used in the first embodiment of the rocker switch, and FIG. 13 is a plan view of the movable contact piece, FIG. 14 is a side view of FIG. 13 as viewed from below, and FIG. 15 is a bottom view of FIG. 13. The movable contact piece 3 has a U-like shape (a hairpin shape) formed by folding back a strip made of a resilient or elastic member such as phosphor bronze, as is understood from FIG. 14, and in this embodiment, the strip is folded such that both strip portions of the U-like strip extending on both sides of the turning portion thereof differ in their lengths from each other.

A movable contact 31 is mounted to the free end portion of the longer strip portion (hereinafter, referred to as first strip portion) 32, and cut-off portions 321 each having a generally rectangular shape in plan are symmetrically formed on both sides of the middle portion thereof, the cut-off portions 321 having substantially same shape and size with each other. This first strip portion 32 has a its forward portion beyond the cut-off portions 321 bended upwardly so as to have an inclination of predetermined degrees in FIG. 14, and the movable contact 31 is fixed to the forward end of this inclined portion.

An elongate aperture 333 is formed in the forward portion near the free end of the shorter strip portion (hereinafter, referred to as second strip portion) 33, the elongate aperture 333 having a generally elliptical shape with its major axis situated in the longitudinal direction of the strip. As will be described later on, the rod 124 of one of the movable contact piece actuators 12 of the operation button 2 is inserted into the elongate aperture 333 with clearance or play between the rod 124 and the periphery of the elongate aperture 333. Two recesses 332 are formed on the forward portion of the shorter strip portion 33 symmetrically at the both sides of the central portion of the elongate aperture 333, the recesses 332 extending in the direction of the width of the strip (in the direction of the minor axis of the elongate aperture 333). Since these recesses 332 are engaged with the generally circular arc-shaped tips 123 of the movable contact piece actuators 12 of the operation button 2, the surfaces of the recesses 332 are formed to have circular arc shapes that conform to the shapes of the tips 123 of the movable contact piece actuators 12, respectively.

Figure 16:
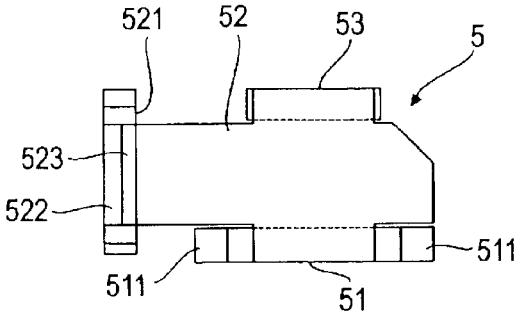
FIG. 16 is a plan view showing a movable contact piece support member used in a first embodiment of the rocker switch according to the present invention.
Figure 17:
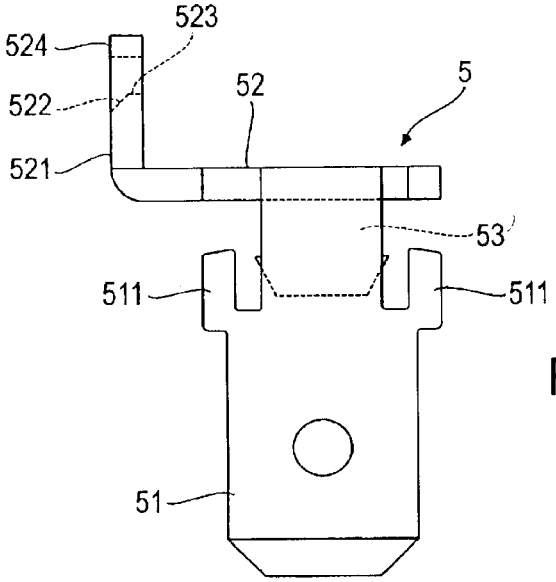
FIG. 17 is a side view of FIG. 16 as viewed from below.
Figure 18:
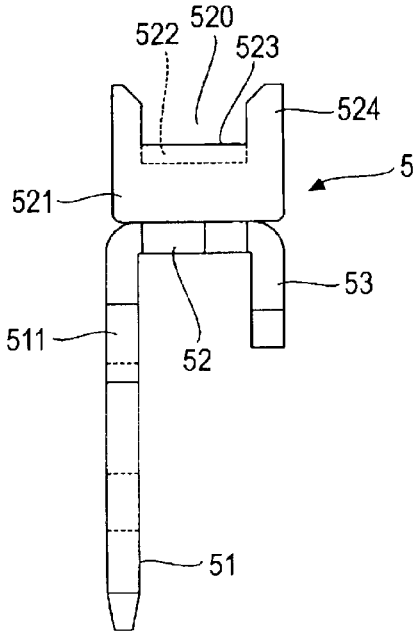
FIG. 18 is a right-hand side view of FIG. 16.

FIGS. 16 to 18 show a movable contact piece support member used in the first embodiment of the rocker switch, and FIG. 16 is a plan view of the movable contact piece support member, FIG. 17 is a side view of FIG. 16 as viewed from below, and FIG. 18 is a right-hand side view of FIG. 16. The movable contact piece support member 5 is manufactured by performing a metalwork for a sheet of metal having an increased rigidity by making the thickness thereof thicker, and comprises: a strip-like terminal portion (tab terminal) 51; a movable contact piece support 52 formed integrally with one end portion in the longitudinal direction of the tab terminal 51 by bending the metal sheet substantially in the direction of making a right angle to the tab terminal 51, the movable contact piece support 52 extending in the direction orthogonal to the tab terminal 51; a retention piece 53 formed by bending the metal sheet substantially at right angles to the movable contact piece support 52 from one end portion thereof opposite to the tab terminal 51 in the same direction as that the tab terminal 51 is extending; and an upright piece 521 for supporting the movable contact piece, that is formed by bending the metal sheet substantially at right angles to the movable contact piece support 52 from one end portion in the longitudinal direction thereof in the opposite direction to that the tab terminal 51 and the retention piece 53 are extending.

As is apparent from FIG. 17, the tab terminal 51 has detent (engagement) pieces 511 for fixing the movable contact piece support member 5 to the box 2, the detent pieces 511 projecting and being formed on both the left and right side edges of the tab terminal 51 above by a little the central portion thereof. As is clear from FIG. 18, a reentrant portion 520 having a generally rectangular shape is formed in the upper side of the movable contact piece support piece 521, and in the reentrant portion 520 is positioned the central portion of the first strip portion 32 of the movable contact piece 3 discussed above. As can be understood from FIG. 17, the top end surface (the surface in the direction of thickness) that faces the reentrant portion 520, of the movable contact piece support piece 521 has a sloped face 522 in the side thereof that the movable contact 31 projects, and the central portion of the first strip portion 32 of the movable contact piece 3 is put on the flat face 523 only remaining on the top end surface of the movable contact piece support piece 521. In other words, this flat face 523 attains the same function as that of a protruding ridge. The cut-off portions 321 formed on the middle portion of the first strip portion 32 of the movable contact piece 3 are inserted into corresponding projections 524 formed on both sides of the reentrant portion 520, respectively. These projections 524 have sloped surfaces inwardly inclined on their top end portions, respectively, which make easy a work that the movable contact piece 3 is assembled on the flat face 523 of the movable contact piece support piece 521.

Figure 19:
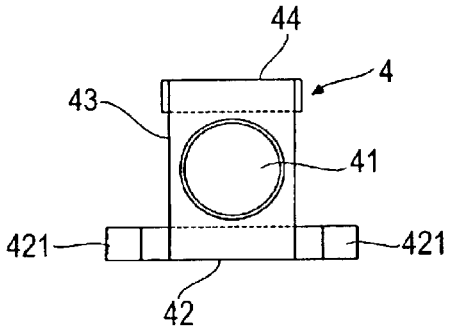
FIG. 19 is a plan view showing a fixed contact piece used in a first embodiment of the rocker switch according to the present invention.
Figure 20:
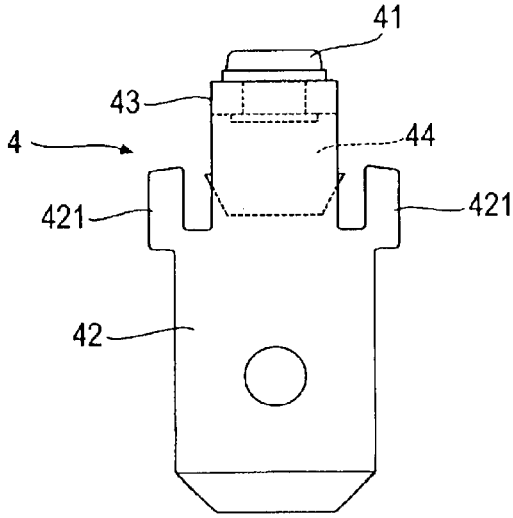
FIG. 20 is a side view of FIG. 19 as viewed from below.
Figure 21:
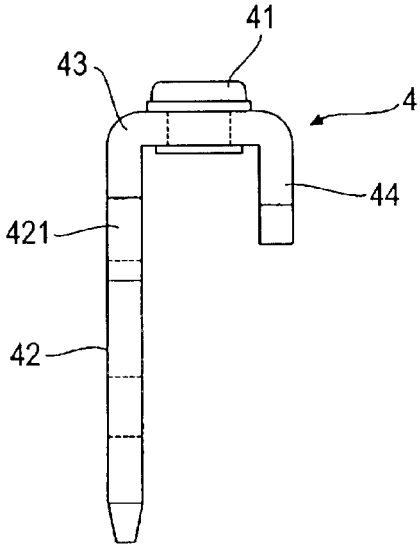
FIG. 21 is a right-hand side view of FIG. 19.

FIGS. 19 to 21 show a fixed contact piece used in the first embodiment of the rocker switch, and FIG. 19 is a plan view of the fixed contact piece, FIG. 20 is a side view of FIG. 19 as viewed from below, and FIG. 21 is a right-hand side view of FIG. 19. This fixed contact piece 4 is manufactured by performing a metalwork for a sheet of metal having an increased rigidity by making the thickness thereof thicker, and comprises: a strip-like terminal portion (tab terminal) 42; a fixed contact support 43 having a generally rectangular shape in plan and formed integrally with one end portion in the longitudinal direction of the tab terminal 42 by bending the metal sheet substantially in the direction of making a right angle to the tab terminal 42; and a retention piece 44 formed by bending the metal sheet from one end portion thereof in the longitudinal direction thereof in the same direction as that the tab terminal 42 is extending and substantially at right angles to the fixed contact support 43. A fixed contact 41 is mounted and fixed on the fixed contact support 43. As is clear from FIG. 20, the tab terminal 42 has detent (engagement) pieces 421 for fixing the fixed contact piece 4 to the box 2, the detent pieces 421 projecting and being formed on both the left and right side edges of the tab terminal 42 above by a little the central portion thereof.

On the other hand, through the bottom wall of the box 2 are formed slits 27 and 28 into which the tab terminal 42 of the fixed contact piece 4 and the tab terminal 51 of the movable contact piece support member 5 are to be inserted, respectively, as shown in FIGS. 6, 9, 11 and 12. In addition, as shown in FIGS. 6, 11 and 12, grooves 29 and 30 in which the retention piece 44 of the fixed contact piece 4 and the retention piece 53 of the movable contact piece support member 5 are fitted, are formed in the inner surface of the bottom wall of the box 2, respectively. The widths of the slits 27 and 28 are constant, but the lengths thereof are not constant and are longer in their portions from halfway toward the bottom surface in the direction of thickness of the bottom wall. That is, each of the slits 27 and 28 is formed such that a portion of its length from substantially the middle to the outer surface of the bottom wall in the direction of depth thereof is made longer than the remaining portion, and steps 271 and 281 are formed at substantially the middles of the slits 27 and 28 in the direction of depth thereof, respectively. As will be described later on, the detent or engagement pieces 421 and 511 of the tab terminals 42 and 51 of the fixed contact piece 4 and of the movable contact piece support member 5 will be engaged with these steps 271 and 28.

In addition, a partition wall 26 is formed integrally with the bottom wall of the box 2, the partition wall 26 extending between the major side walls thereof. This partition wall 26 comprises a first protruding ridge portion 261 hanging down from the outer surface of the bottom wall of the box 2 and substantially in parallel with the minor side walls thereof and a second protruding ridge portion 262 projecting inwardly from the inner surface of the bottom wall of the box 2 substantially at right angles to the inner surface and substantially in parallel with the minor side walls thereof. The first protruding ridge portion 261 is located at substantially the central portion of the bottom surface of the box 2, and the second protruding ridge portion 262 is located on a side of the inner surface near the slits 27 into which the tab terminals 42 of the fixed contact pieces 4 are to be inserted.

Next, there will be briefly explained a process of assembling the first embodiment of the rocker switch using the components described above.

At first, the tab terminal 42 of the fixed contact piece 4 is inserted into the slit 27 for the fixed contact piece formed through the bottom wall of the box 2, and the tab terminal 42 of the fixed contact piece 4 is pulled out toward the outside. In this occasion, the retention piece 44 of the fixed contact piece 4 is fitted in the fit-in groove 29. In the state that the tab terminal 42 of the fixed contact piece 4 has been completely pulled out toward the outside, the detent pieces 421 of the tab terminal 42 are forcedly bent outwardly by use of a jig so that they can be engaged with the corresponding steps 271, respectively. Similarly, the remaining fixed contact piece 4 is secured by engaging the detent pieces 421 thereof with the corresponding steps 271 by use of a jig. Successively, the tab terminal 51 of the movable contact piece support member 5 is inserted into the slit 28 for the movable contact piece support member formed through the bottom wall of the box 2, and the tab terminal 51 of the movable contact piece support member 5 is pulled out toward the outside. In this occasion, the retention piece 53 of the movable contact piece support member 5 is fitted in the fit-in groove 30. In the state that the tab terminal 51 of the movable contact piece support member 5 has been completely pulled out toward the outside, the detent pieces 511 of the tab terminal 51 are forcedly bent outwardly by use of a jig so that they can be engaged with the corresponding steps 281, respectively. Likewise, the remaining movable contact piece support member 5 is secured by engaging the detent pieces 511 thereof with the corresponding steps 281 by use of a jig.

Thereafter, the movable contact piece 3 is mounted on the movable contact piece support 52 of the movable contact piece support member 5 already secured to the bottom wall of the box 2. Specifically, the cut-off portions 321 formed on the middle portion of the first strip portion 32 of the movable contact piece 3 are inserted into the projections 524 of the movable contact piece support piece 521 that stands erect from the movable contact piece support 52 in the state that the movable contact 31 projects outwardly of the sloped face 522 of the movable contact piece support piece 521, the projections 524 being formed on both sides of the reentrant portion 520, thereby to put the middle portion of the first strip portion 32 of the movable contact piece 3 on the flat face 523 of the movable contact piece support piece 521.

In the state that two movable contact pieces 3 have been put on the corresponding flat faces 523 of the movable contact piece support piece 521, the operation button 1 is positioned above the opening portion of the box 2, and the forward end of the rod 124 of each of the movable contact piece actuators 12 is inserted into the oval aperture 333 of the corresponding one of the movable contact pieces 3. Thereafter, the operation button 1 is pushed down from the upper side thereof so that the rotatable shafts 11 of the operation button 1 can be fitted in the bearing apertures 25 of the box 2, respectively. Since each rotatable shaft 11 of the operation button 1 has been formed, as is clear from FIG. 3, such that the lower end portion below the central portion thereof has a sloped face inwardly inclined, the rotatable shafts 11 are relatively easily fitted in the bearing apertures 25 of the box 2 by depressing the operation button 1. Thus, the first embodiment of the rocker switch according to the present invention is assembled.

When the rotatable shafts 11 of the operation button 1 have been fitted in the bearing apertures 25 of the box 2, the rotatable shafts 11 of the operation button 1 is rotatably supported by the bearing apertures 25 of the box 2 so that the operation button 1 can seesaw. In addition, the rod 124 of each movable contact piece actuator 12 of the operation button 1 has been inserted into the oval aperture 333 of the corresponding one of the movable contact pieces 3 with a clearance or play between the rod 124 and the periphery of the oval aperture 333, and each movable contact piece actuator 12 is in a situation that its circular arc-shaped tip 123 has been engaged with the circular arc-shaped recess 332 of corresponding one of the movable contact pieces 3. Since each movable contact piece 3 merely has been swingably engaged with the reentrant portion 520 of the movable contact piece support piece 521 as stated above, it is not in stable state. The stable position of the movable contact piece 3 is either one of two positions one of which is switch-on position where the movable contact 31 is in contact with the fixed contact 41 and the other of which is switch-off position where the movable contact 31 is away from the fixed contact 41 by a predetermined distance. Accordingly, when the rotatable shafts 11 of the operation button 1 have been fitted in the bearing apertures 25 of the box 2, the movable contact piece 3 swingingly moves to either one of the two positions, that is, the switch-on position where the movable contact 31 is in contact with the fixed contact 41 and the switch-off position where the movable contact 31 is away from the fixed contact 41 by a predetermined distance, and hence the operation button 1 also rotates and stops at a position corresponding to either one position.

Figure 22:
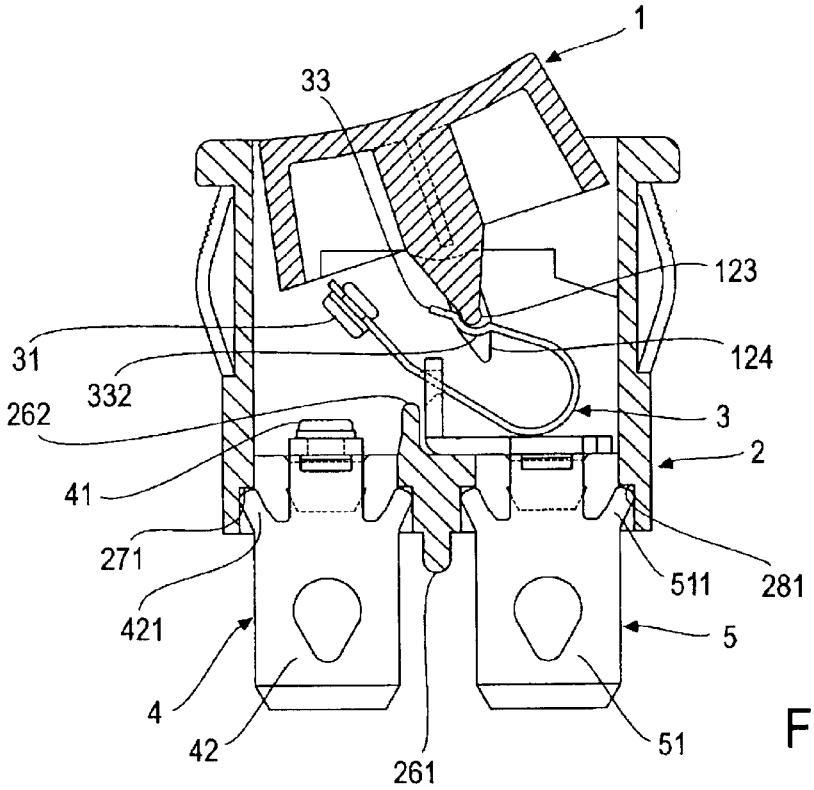
FIG. 22 is a generally sectional view showing the switch-off state of a first embodiment of the rocker switch according to the present invention.
Figure 23:
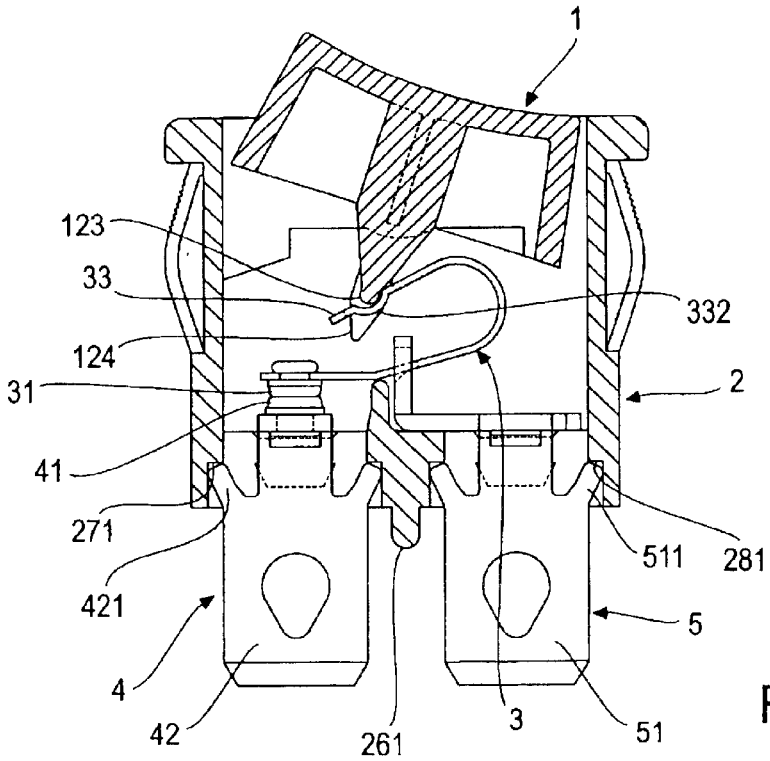
FIG. 23 is a generally sectional view showing the switch-on state of a first embodiment of the rocker switch according to the present invention.

FIG. 22 is a generally sectional view showing the state that the operation button 1 is stopping at the switch-off position where the movable contact 31 is away from the fixed contact 41 by a predetermined distance, and FIG. 23 is a generally sectional view showing the state that the operation button 1 is stopping at the switch-on position the movable contact 31 is in contact with the fixed contact 41. As is clear from FIG. 22, in case the movable contact 31 is situated at the switch-off position where it is away from the fixed contact 41 by a predetermined distance, the turning portion of the movable contact piece 3 is in contact with the top surface of the movable contact piece support 52 of the movable contact piece support member 5, and therefore, the movable contact piece 3 is in stable state.

As is apparent from the foregoing discussions, in the first embodiment of the rocker switch, it is possible to mount or assemble the fixed contact piece 4 and the movable contact piece support member 5 in the box 2 and to secure them simply and easily with accuracy and stability. In addition, the rocker switch is constructed such that the forward end of the rod 124 of each of the movable contact piece actuators 12 of the operation button 1 is inserted into the oval aperture 333 of the corresponding one of the movable contact pieces 3, and then, the operation button 1 is pushed down from the upper side thereof so that the rotatable shafts 11 of the operation button 2 are fitted in the bearing apertures 25 of the box 2, respectively. As a result, when assembled, the operation button 1 can accurately and stably be mounted to the box 2 for seesaw movement without any trouble or accident that the movable contact piece 3 falls off the movable contact piece support member 5 or the movable contact piece 3 is injured or damaged.

Moreover, the rocker switch is constructed such that the rod 124 of each movable contact piece actuator 12 of the operation button 1 is inserted into the oval aperture 333 of the corresponding one of the movable contact pieces 3 with a clearance or play between the rod 124 and the periphery of the oval aperture 333 as well as the circular arc-shaped tip 123 of each movable contact piece actuator 12 is engaged with the circular arc-shaped recess 332 of corresponding one of the movable contact pieces 3 thereby to operate as if they are linked. In other words, engagement between the circular arc-shaped tip 123 of each movable contact piece actuator 12 of the operation button 1 and the circular arc-shaped recess 332 of the corresponding movable contact piece 3 is not in the sliding friction state as in the prior art but in the rolling friction state. As a result, when the operation button 1 is operated, there can be obtained actual feeling that the operation button 1 swings lightly and smoothly (without feeling a resistance thereto) as well as that the operation button 1 has positively stopped at its switch-on position or switch-off position. That is, feeling in actuation of the operation button 1 comes to much favorable or excellent. Furthermore, since the conical rod 124 of each movable contact piece actuator 12 of the operation button 1 is inserted into the oval aperture 333 of the corresponding one of the movable contact pieces 3 with a clearance between the rod 124 and the periphery of the elongate aperture 333, it is ensured that there occurs no trouble or accident that a displacement in position of each movable contact piece 3 occurs or the movable contact piece falls off due to an external shock, and hence it is possible to make the operation of the rocker switch stable.

The middle portion of the first strip portion 32 of the movable contact piece 3 is put on the flat face 523 of the movable contact piece support piece 521 which functions as a protruding ridge by the sloped face 522 of the movable contact piece support piece 521, and therefore, the movable contact piece 3 and the movable contact piece support member 5 are electrically and mechanically brought into contact with each other without fail. In addition, since the movable contact piece 3 is put on the flat face 523 of the movable contact piece support piece 521 which functions as a protruding ridge, the movable contact piece 3 can quickly be swung. In particular, because of provision of the sloped face 522, not only the swinging operation of the movable contact piece 3 to its switch-off position but also the swinging operation of the movable contact piece 3 to its switch-on position becomes very quick. Moreover, in case of operating the movable contact piece 3 in the reverse direction, the conical rod 124 is inserted into the oval aperture 333 of the corresponding one of the movable contact pieces 3 with a clearance between the rod 124 and the periphery of the oval aperture 333, and hence any displacement does not occur in positions where the movable contact piece actuators 12 of the operation button 1 push the corresponding movable contact pieces 3. For that reason, more stable reverse operation of the movable contact pieces 3 is obtained, and more favorable or excellent feeling in actuation of the operation button 1 is also obtained as well as there is ensured the quick reverse operation of the movable contact piece 3 with a click. The more quick reverse operation of the movable contact piece 3 results in lesser bounce time in throwing the movable contact piece 3 to its switch-on position as well as smaller arc occurring in throwing the movable contact piece 3 to its switch-off position. As a result, wear and tear of the contacts are further restrained and there can be provided the contacts the lifetime of which is much more longer.

Next, there will be described a second embodiment of the rocker switch according to the present invention in detail with reference to FIGS. 24 to 26.

Figure 24:
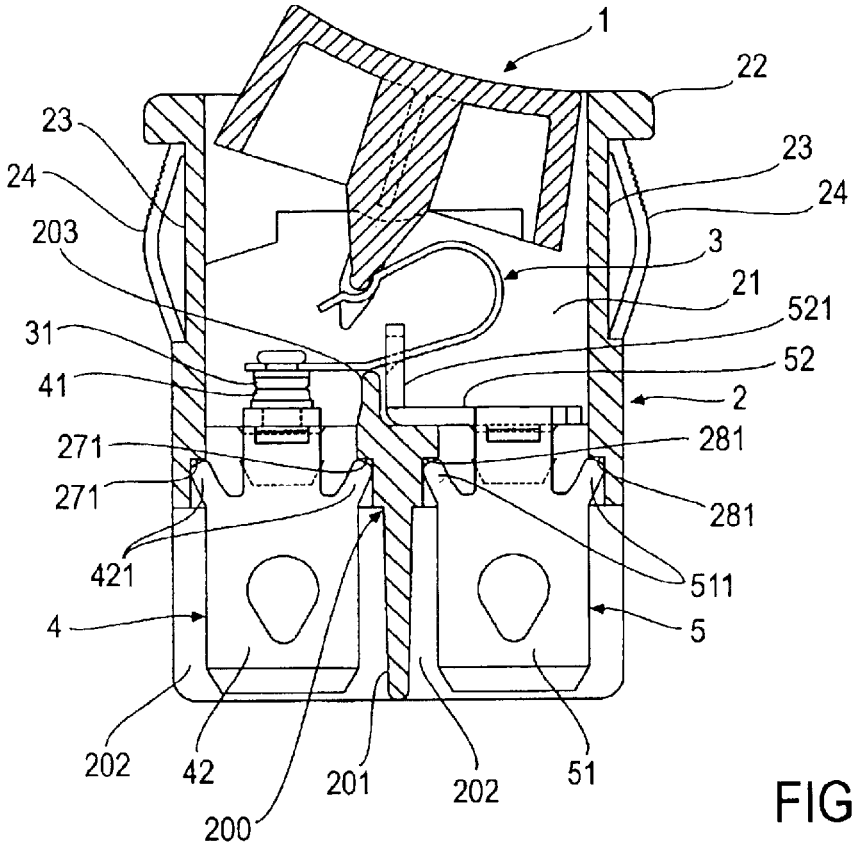
FIG. 24 is a generally sectional view showing the switch-on state of a second embodiment of the rocker switch according to the present invention.
Figure 25:
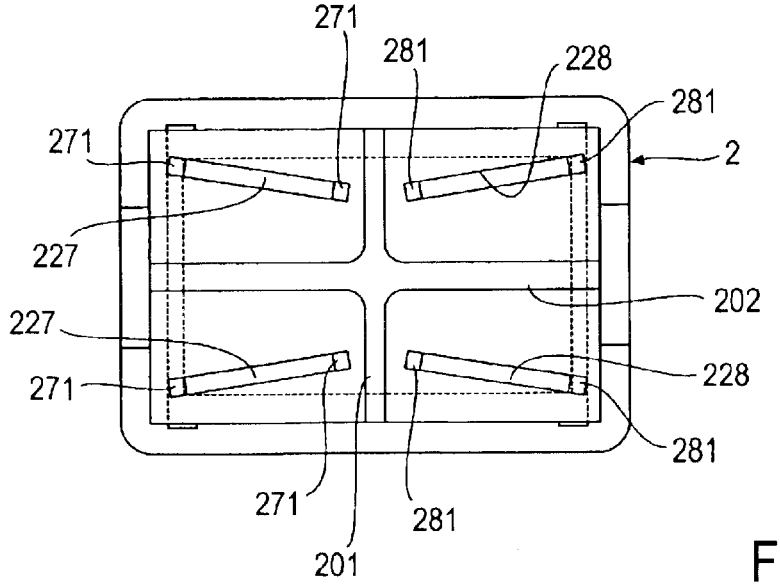
FIG. 25 is a bottom view of a box used in a second embodiment of the rocker switch according to the present invention.
Figure 26:
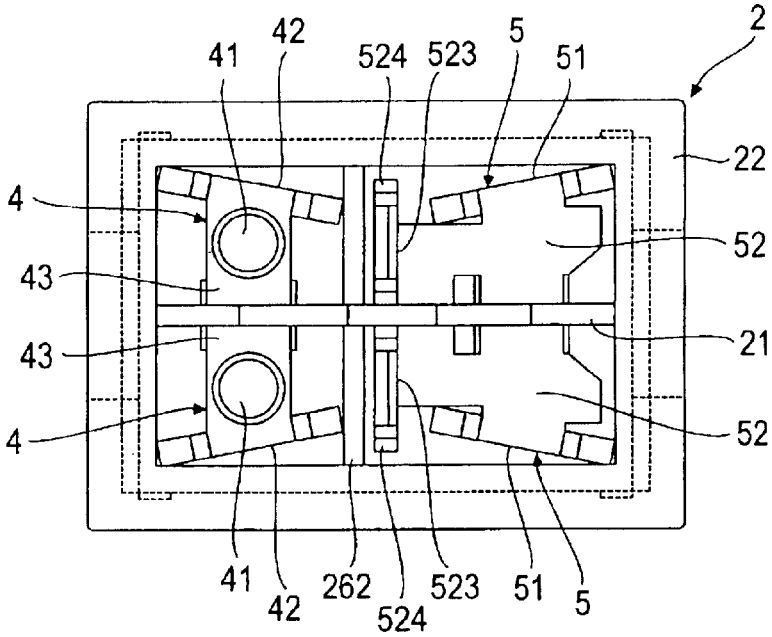
FIG. 26 is a plan view showing the state that two fixed contact pieces and two movable contact piece support members have been mounted in the box shown in FIG. 25.

FIG. 24 is a generally sectional view showing the switch-on state of a second embodiment of the rocker switch according to the present invention, FIG. 25 is a bottom view of a box used in the second embodiment of the rocker switch according to the present invention, and FIG. 26 is a plan view showing the state that two fixed contact pieces and two movable contact piece support members have been mounted in the box shown in FIG. 25. The second embodiment of the rocker switch differs, mainly in the structure of the box, specifically, in the structure of the bottom wall of the box, from the box of the above-described first embodiment. Therefore, in FIGS. 24-26, elements, components, members and/or portions corresponding to those in FIGS. 1-23 will be denoted by the same reference numbers and/or characters attached thereto, and the explanation of the operation button 1, the movable contact piece 3, the movable contact piece support member 5, and the fixed contact piece 4 will be omitted unless necessary.

As already described, TAB 187 terminal of IEC (International Electrotechnical Commission) standard is used as a terminal portion (tab terminal) of a rocker switch of rated current 10A type, and it is necessary that TAB 250 terminal of IEC standard is used as a terminal portion (tab terminal) of a rocker switch of rated current 16A type. The width of TAB 187 terminal is 4.75 mm, while the width of TAB 250 terminal is 6.35 mm. Therefore, the width of TAB 250 terminal is wider by 1.6 mm than that of TAB 187 terminal.

The rocker switch of the first embodiment described above is one of rated current 10A type, and both the tab terminal 42 of the fixed contact piece 4 and the tab terminal 51 of the movable contact piece support member 5 are TAB 187 terminal of IEC standard and so the widths thereof are 4.75 mm. A distance between adjacent tab terminals 42 and 51 of the fixed contact piece 4 and of the movable contact piece support member 5 is thoroughly larger than the insulation distance or creepage distance of IEC standard (larger than 3 mm). However, in case the slits 27 and 28 formed through the bottom wall of the box 2 of the rocker switch of the first embodiment are lengthened in their lengths so as to conform to the width 6.35 mm of TAB 250 terminal and a rocker switch of rated current 16A type is assembled by inserting TAB 250 terminals into the slits 27 and 28, a distance between adjacent tab terminals 42 and 51 of the fixed contact piece 4 and of the movable contact piece support member 5 becomes shorter than the insulation distance of IEC standard, and hence such rocker switch does not fulfill the IEC standard.

The rocker switch of the second embodiment is one of rated current 16A type in which there is used a box having the same width and depth (the lengths of the major side direction and of the minor side direction of the box 2) as those of the box used in the rocker switch of the first embodiment and TAB 250 terminals of IEC standard are inserted into the box. The rocker switch of the second embodiment has an insulation distance or creepage distance between adjacent tab terminals 42 and 51 of the fixed contact piece 4 and of the movable contact piece support member 5, which fulfills the IEC standard.

The box 2 used in the rocker switch of the second embodiment is also a rectangular box the top of which is open and having a generally rectangular shape in plan like the box 2 used in the rocker switch of the first embodiment, and a partition wall 21 is formed in the box 2 at the central portion thereof along the longitudinal direction of the box 2, the partition wall 21 dividing the interior of the box 2 into two substantially same rooms. Since the rocker switch of this second embodiment is also a double pole-single throw (DPST) switch, there are required two rooms in which two sets of switch components are accommodated respectively. For this reason, the interior of the box 2 is partitioned into two rooms by the partition wall 21. A flange 22 having a generally rectangular shape is formed integrally with the opening portion of the box 2, and recesses 23 for mounting leaf springs are formed in a pair of opposed minor side walls of the box 2, each recess 23 extending downwardly from a wall portion immediately below the flange 22 by a predetermined length. Leaf springs 24 each being curved outwardly are mounted in the corresponding recesses 23, respectively.

As shown in FIG. 25, through the bottom wall of the box 2 are slantingly formed slits 227 and 228 into which the tab terminal 42 of each fixed contact piece 4 and the tab terminal 51 of each movable contact piece support member 5 are to be inserted, respectively, these slits 227 and 228 being extending from the four corners of the bottom wall in the direction that forms a predetermined acute angle with the major side wall of the box 2. Like the slits 27 and 28 of the first embodiment, the widths of these slits 227 and 228 are constant, but the lengths thereof are not constant and are longer in their portions from halfway toward the bottom surface in the direction of thickness of the bottom wall. That is, each of the slits 227 and 228 is formed such that a portion of its length from substantially the middle to the outer surface of the bottom wall in the direction of depth thereof is made longer than the remaining portion, and steps 271 and 281 are formed at substantially the middles of the slits 227 and 228 in the direction of depth thereof, respectively. The detent or engagement pieces 421 and 511 of the tab terminals 42 and 51 of the fixed contact piece 4 and of the movable contact piece support member 5 are engaged with these steps 271 and 28. Further, though not shown, grooves in which a retention piece of each fixed contact piece 4 and a retention piece of each movable contact piece support member 5 are fitted, are formed in the inner surface of the bottom wall of the box 2, respectively. In addition, as can easily be understood from FIG. 26, the tab terminal 42 of the fixed contact piece 4 and the tab terminal 51 of the movable contact piece support member 5 are bent downwardly such that they form an angle with the side edges of the fixed contact support 43 and the movable contact piece support 52 respectively, this angle being substantially the same as the angle of inclination of the slits 227 and 228. Further, the movable contact piece support 52 of the movable contact piece support member 5 has its shape in plan that is somewhat different from that of the movable contact piece support 52 used in the first embodiment, as shown in FIG. 26, because the tab terminal 51 thereof is bent vertically downwardly such that it forms an angle with the side edge of the movable contact piece support 52.

A partition wall 200 formed integrally with the bottom wall of the box 2 comprises: a first protruding ridge portion 201 hanging down to a position a little beyond the forward ends of the tab terminal 42 of the fixed contact piece 4 and the tab terminal 51 of the movable contact piece support member 5 from substantially the central portion of the outer surface of the bottom wall substantially in parallel with the minor side walls thereof; a second protruding ridge portion 202 hanging down to a position a little beyond the forward ends of the tab terminal 42 of the fixed contact piece 4 and the tab terminal 51 of the movable contact piece support member 5 from substantially the central portion of the outer surface of the bottom wall substantially in parallel with the major side walls thereof; and a third protruding ridge portion 203 projecting inwardly from the inner surface of the bottom wall substantially at right angles to the inner surface and substantially in parallel with the minor side walls thereof. The first and third protruding ridge portions 201 and 203 extend between the major side walls, respectively, and the second protruding ridge portion 202 extends between the minor side walls. In practice, the first and second protruding ridge portions 201 and 202 are formed as a united partition wall having a generally cross shape in plan as shown in FIG. 25. These protruding ridge portions 201 and 202 isolate the tab terminals 42 of the two fixed contact pieces 4 and the tab terminals 51 of the two movable contact piece support members 5 from one another when the four tab terminals are pulled out toward the outside through the corresponding slits 227 and 228 and are secured by use of their detents. Further, the third protruding ridge portion 203 is situated on a side of the inner surface near the slits 227 into which the tab terminals 42 of the fixed contact pieces 4 are to be inserted.

In this manner, with the construction that the slits 227 and 228 into which the tab terminals 42 of the fixed contact pieces 4 and the tab terminals 51 of the movable contact piece support members 5 are inserted, are obliquely formed to extend from the four corners of the bottom wall of the box 2 in the direction that forms a predetermined acute angle with the major side wall of the box 2 and that the four tab terminals are separated by the first and second protruding ridge portions 201 and 202 formed as a united partition wall having a generally cross shape in plan, an insulation or creepage distance between adjacent tab terminals 42 and 51 of the fixed contact piece 4 and of the movable contact piece support member 5 thoroughly fulfills the IEC standard. For example, if an angle of inclination of the slits 227 and 228 against the major side wall is set to about 15°, a straight distance between the side edge of the tab terminal 42 of the fixed contact piece 4 inserted into the corresponding slit 227 and the end portion of the first protruding ridge portion 201 as well as a straight distance between the side edge of the tab terminal 51 of the movable contact piece support member 5 inserted into the corresponding slit 228 and the end portion of the first protruding ridge portion 201 are both about 2.38 mm. If the thickness of the first protruding ridge portion 201 is set to 1 mm, the creepage distance between adjacent tab terminals 42 and 51 of the fixed contact piece 4 and of the movable contact piece support member 5 comes to about 5.76 mm, which is thoroughly larger than the insulation distance of IEC standard that is larger than 3 mm. In addition, the straight distance between adjacent tab terminals 42 and 51 of the fixed contact piece 4 and of the movable contact piece support member 5 is larger than 3 mm. Accordingly, a sufficient dielectric strength is obtained. Further, the creepage distance and straight distance between the tab terminal 42 of the fixed contact piece 4 and the tab terminal 51 of the movable contact piece support member 5 are increased as an angle of inclination of the slits 227 and 228 against the major side wall grows larger.

Thus, there is provided the rocker switch of rated current 16A type in which there is used a box having the same width and depth as those of the box of a rocker switch of rated current 10A type and TAB 250 terminals of IEC standard are inserted into the box. It is needless to say that same function and effects as those of the first embodiment can also be obtained by this rocker switch, and yet, this rocker switch can be mounted on various kinds of machines, apparatus, equipments, instruments or the like each of which does not have a space in which a rocker switch having its width and depth larger than those of the rocker switch of rated current 10A type can be accommodated. Consequently, there is obtained an advantage that OA machines or equipments, amusement and game machines, measurement instruments, medical instruments and the like, for example, can be modified to ones each having larger rated current/voltage value without increasing sizes thereof. Further, the height (the length in the direction of forming right angles with the bottom wall of the box 2) of the rocker switch of the second embodiment becomes higher by a difference in length between TAB 187 terminal and TAB 250 terminal that is longer than TAB 187 terminal. Since a power supply cable or the like will be connected to each tab terminal, there is usually a slight room in a space in the direction of height thereof, and hence the rocker switch of the second embodiment can be mounted instead of the rocker switch of rated current 10A type without occurrence of any problem.

Next, there will be described a third embodiment of the rocker switch according to the present invention in detail with reference to FIGS. 27 to 32.

Figure 31:
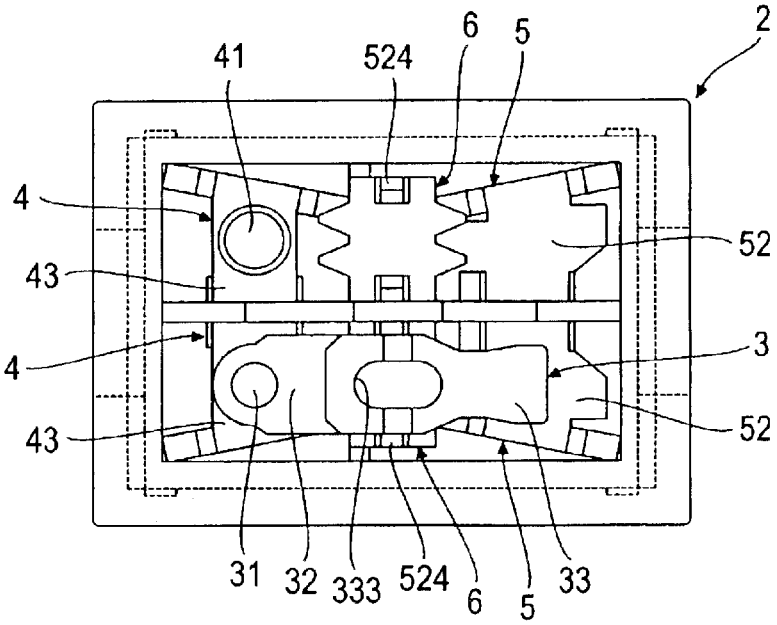
FIG. 31 is a plan view showing the state that the resilient piece shown in FIGS. 27-29 has been mounted on one of the two movable contact piece support members shown in FIG. 26 and on the other of the two movable contact piece support members has been mounted both the resilient piece and the movable contact piece.
Figure 28:
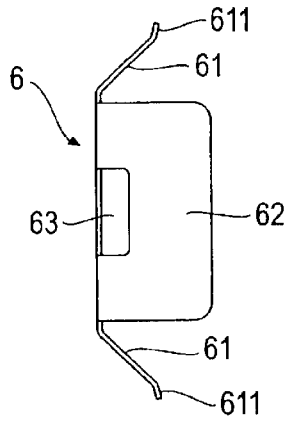
FIG. 28 is a left-hand side view of FIG. 27.
Figure 27:
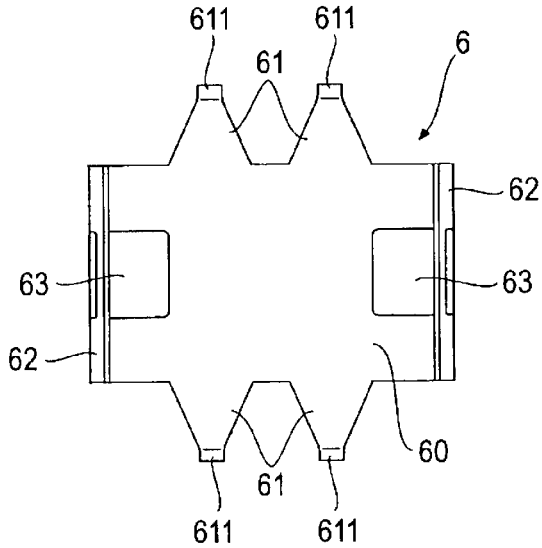
FIG. 27 is a plan view showing a conductive resilient piece used in a third embodiment of the rocker switch according to the present invention.
Figure 29:
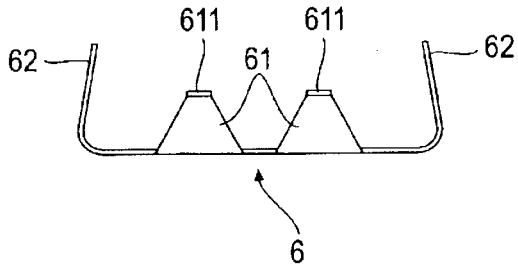
FIG. 29 is a side view of FIG. 27 as viewed from below.
Figure 30:
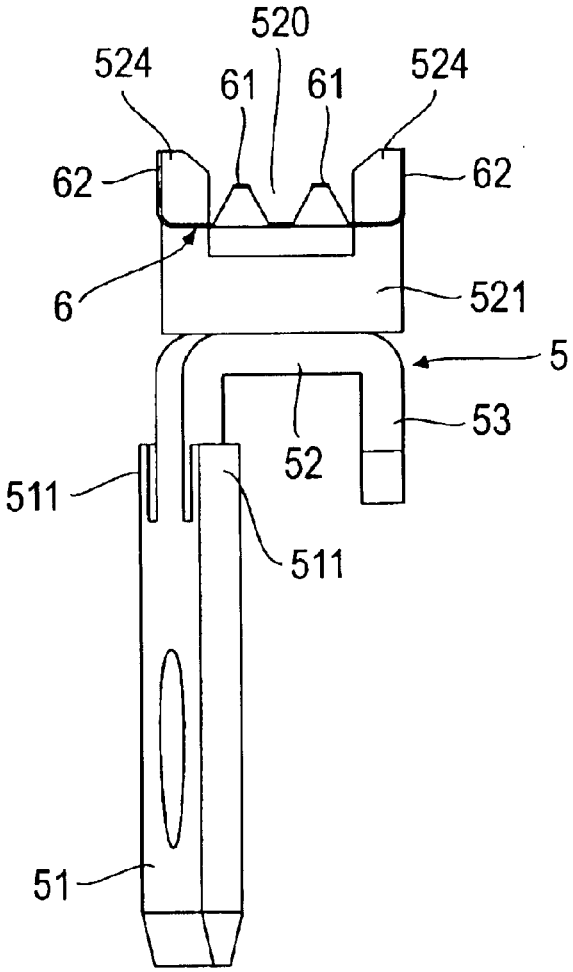
FIG. 30 is a generally perspective view showing the state that the resilient piece shown in FIGS. 27-29 has been mounted on a movable contact piece support of the movable contact piece support member used in a second embodiment.
Figure 32:
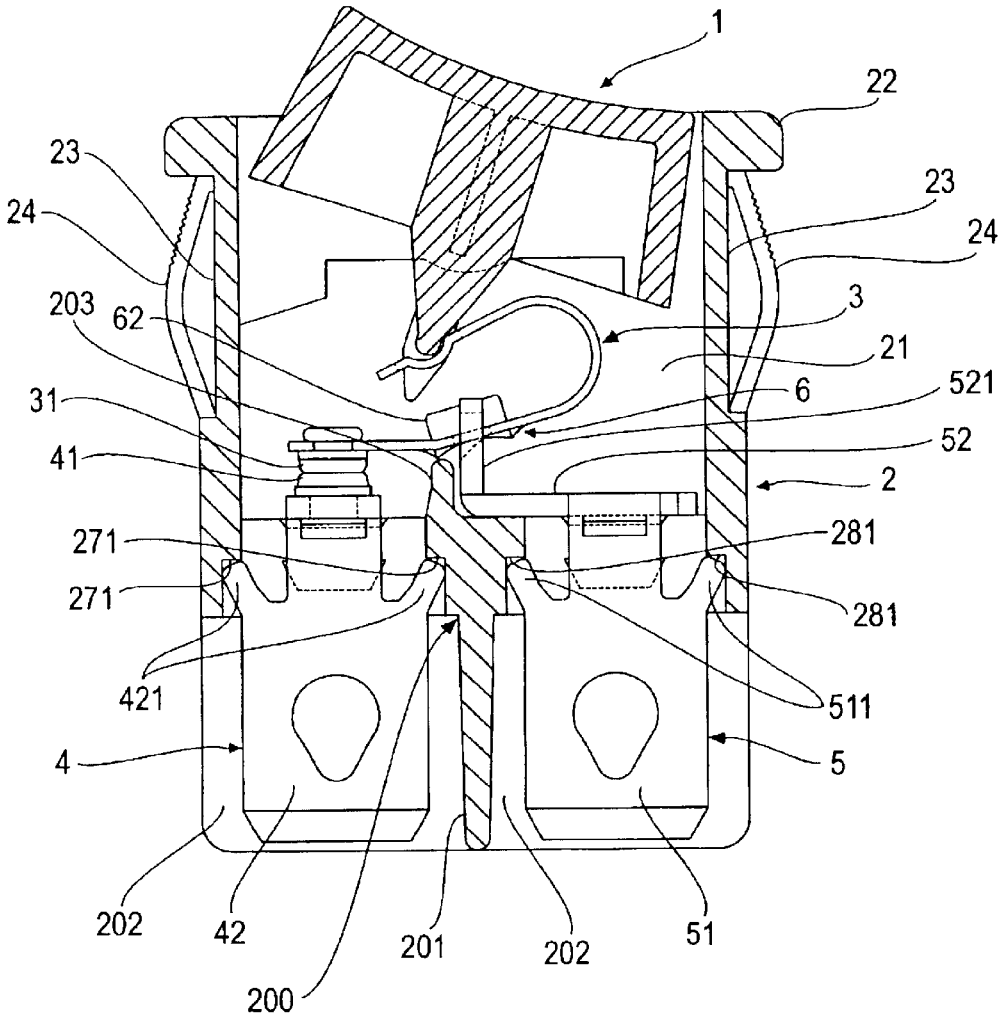
FIG. 32 is a generally sectional view showing the switch-on state of a third embodiment of the rocker switch according to the present invention.

FIG. 27 is a plan view showing a conductive resilient piece used in a third embodiment of the rocker switch according to the present invention, FIG. 28 is a left-hand side view of FIG. 27, FIG. 29 is a side view of FIG. 27 as viewed from below, FIG. 30 is a generally perspective view showing the state that the resilient piece shown in FIGS. 27-29 has been fitted in the movable contact piece support piece 521 that stands erect from the movable contact piece support 52 of the movable contact piece support member 5 used in the second embodiment, FIG. 31 is a plan view showing the state that the resilient piece shown in FIGS. 27-29 has been fitted in both of the two movable contact piece support members 5 shown in FIG. 26 and further, the movable contact piece 3 shown in FIGS. 13-15 has been mounted on one of the two resilient pieces, and FIG. 32 is a generally sectional view showing the switch-on state of a third embodiment of the rocker switch according to the present invention.

The third embodiment of the rocker switch differs from the second embodiment of the rocker switch only in the point that in the second embodiment of the rocker switch, the conductive resilient piece 6 shown in FIGS. 27-29 is fitted in the movable contact piece support piece 521 standing erect from the movable contact piece support 52 of the movable contact piece support member 5 and further, the movable contact piece 3 shown in FIGS. 13-15 is mounted on the conductive resilient piece 6. That is, in the third embodiment, on the movable contact piece support piece 521 is mounted the movable contact piece 3 through the conductive resilient piece 6 therebetween. Therefore, in FIGS. 27-32, elements, components, members and/or portions corresponding to those in FIGS. 1-26 will be denoted by the same reference numbers and/or characters attached thereto, and the explanation of the operation button 1, the movable contact piece 3, the movable contact piece support member 5, and the fixed contact piece 4 will be omitted unless necessary.

The conductive resilient piece 6 is a spring manufactured by performing a metalwork for an electrically conductive strip made of a resilient or elastic member such as phosphor bronze, and as shown in FIGS. 27-29, it comprises: a resilient piece body 60 having a generally rectangular shape in plan; protrusions 61 bent obliquely and upwardly toward the outside from the side edge of each of the major sides of the resilient piece body 60 at predetermined intervals, two protrusions 61 being formed on each side edge thereof and each having a generally truncated triangular shape; and a pair of opposed retentive pieces 62 formed by bending both side portions in the longitudinal direction of the resilient piece body 60 over a predetermined length thereof at an angle that is a little larger than a right angle.

Each of the four protrusions 61 has its forward end 611 bent substantially in parallel with the surface of the resilient piece body 60 but slightly upwardly as shown in FIG. 28, and the two protrusions 61 located on the one side edge and the two protrusions 61 located on the other side edge are formed face to face on the resilient piece body 60. A pair of through holes 63 is formed in the both side portions in the longitudinal direction of the resilient piece body 60 at the central portions thereof, and extends to the corresponding retentive pieces 62. These through holes 63 have their shapes and sizes fitted in the projections 524 formed on the both sides of the reentrant portion 520 in the movable contact piece support piece 521 standing erect from the movable contact piece support 52 with a clearance or play between the periphery of each through hole 63 and each projection 524. Further, as shown in FIG. 30, adjacent two protrusions 61 are formed such that they are situated between the opposed inner walls of the two projections 524.

As shown in FIG. 29, a pair of the retentive pieces 62 is slightly inclined inwardly of the resilient piece body 60, and when the resilient piece 6 is attached to the movable contact piece support piece 521 by fitting a pair of the through holes 63 of the resilient piece 6 in a pair of the projections 524 of the movable contact piece support piece 521 with a clearance therebetween, as shown in FIG. 30, a pair of the retentive pieces 62 is pressed outwardly by the outer walls of the projections 524 so that they take substantially upright state. In other words, a pair of the retentive pieces 62 nips a pair of the projections 524 therebetween. Accordingly, the two retentive pieces 62 abut and press against the corresponding outer walls of the projections 524 by their resilient forces, and hence the resilient piece 6 is held in the reentrant portion 520 of the movable contact piece support 52 in the state that the bottom surface of the resilient piece body 60 is put on the flat face 523 of the movable contact piece support piece 521. In addition, as can be understood from FIG. 31, the width of each retentive piece 62 is considerably wider than that of the wall surface of the projection 524 against which each retentive piece 62 abuts. Therefore, each retentive piece 62 is sufficiently in contact with the wall surface of the corresponding projection 524 of the movable contact piece support piece 521, and they are electrically well connected with each other. As a result, the resilient piece 6 and the movable contact piece support member 5 are also electrically well connected with each other due to the electrical contact between the bottom surface of the resilient piece body 60 and the flat face 523 of the movable contact piece support piece 521 as well as the electrical contact between the two retentive pieces 62 and the corresponding projections 524 of the movable contact piece support piece 521. Further, in this embodiment, the height of each retentive piece 62 is set to be approximately equal to the height of the corresponding projection 524 of the movable contact piece support piece 521, and it is needless to say that the height of each retentive piece 62 is not limited to such value.

On the other hand, as shown in FIG. 31, the movable contact piece 3 is put on the resilient piece 6. In this occasion, the cut-off portions 321 (see FIG. 15) formed on the middle portion of the first strip portion 32 of the movable contact piece 3 are inserted into the corresponding projections 524 of the movable contact piece support piece 521 with a clearance between the cut-off portions 321 and the projections 524, and the middle portion of this first strip portion 32 is mainly put on the resilient piece 6. Accordingly, the bottom surface of the first strip portion 32 of the movable contact piece 3 is in contact with the forward ends 611 of the four protrusions 61 of the resilient piece 6. As discussed above, since the second strip portion 33 of the movable contact piece 3 is depressed by the movable contact piece actuator 12 of the operation button 1, the first strip portion 32 is also depressed toward the resilient piece 6. Since each of the four protrusions 61 of the resilient piece 6 has an elastic force, the bottom surface of the first strip portion 32 of the movable contact piece 3 and the forward ends 611 of the four protrusions 61 of the resilient piece 6 are in pressure contact state with each other. In addition, the forward ends 611 of the four protrusions 61 of the resilient piece 6 are depressed by the bottom surface of the first strip portion 32 of the movable contact piece 3, which results in that the central portion of the resilient piece body 60 is warped upwardly as shown in FIG. 32 and comes into contact with the bottom surface of the first strip portion 32 of the movable contact piece 3. Consequently, the movable contact piece 3 is electrically well connected with the resilient piece 6.

The two retentive pieces 62 are merely in pressure contact with the corresponding projections 524 of the movable contact piece support piece 521 and are not in secured state therewith. Moreover, the two retentive pieces 62 nip the projections 524 therebetween by only their elastic forces. Accordingly, as the movable contact piece 3 is rocked, the resilient piece 6 is also rocked with ease to get to the switch-on position shown in FIG. 32 or the switch-off position not shown where the movable contact 31 is away from the fixed contact 41. Since the two retentive pieces 62 are in pressure contact with the corresponding projection 524 of the movable contact piece support piece 521 and the width of each retentive piece 62 is considerably wider than that of the projection 524, even during rocking movement thereof, each retentive piece 62 is in well contact with the wall surface of the corresponding projection 524. As a result, the resilient piece 6 and the movable contact piece support member 5 are always in well electrically connection with each other, and yet, since the forward ends 611 of the four protrusions 61 of the resilient piece 6 are in pressure contact with the bottom surface of the first strip portion 32 of the movable contact piece 3, the resilient piece 6 and the movable contact piece 3 are also always in well electrically connection with each other. Thus, when a bounce occurs, no arc occurs between the movable contact piece 3 and the movable contact piece support piece 521 and a lifetime of these components are greatly lengthened.

In such way, with the construction that the resilient piece 6 made of a conductive elastic member (a spring member) is put between the flat face 523 of the movable contact piece support piece 521 and the movable contact piece 3 in the state that the resilient piece 6 is in pressure contact with both the support piece 521 and the movable contact piece 3, not only the same function and effects as those of the second embodiment are obtained but also occurrence of an arc between the movable contact piece 3 and the movable contact piece support piece 521 due to a bounce of the movable contact piece on turning the rocker switch on or off, can perfectly be prevented because the movable contact piece support piece 521 and the movable contact piece 3 are always in well electrically connection through the conductive resilient piece 6. Consequently, a lifetime of the switch is considerably lengthened. In addition, since the conductive resilient piece 6 is mounted to the movable contact piece support piece 521 by merely pressing and abutting a pair of the retentive pieces 62 thereof against the projections 524 of the movable contact piece support piece 521 to bring into contact therewith, the mounting work of the resilient piece 6 is easy. Accordingly, there occurs no problem in working efficiency. Further, it goes without saying that the number of the protrusions 61 is not limited to four.

In the first, second and third embodiments, it is constructed that the detent (engagement) pieces 421 and 511 of the tab terminals 42 and 51 are formed integrally therewith on the both side edges in the direction of the widths thereof, the detent pieces 421 and 511 projecting in the direction of the widths of the tab terminals 42 and 51, and the tab terminals 42 and 51 are secured by forcedly bending the detent pieces 421 and 511 outwardly in the direction of the widths thereof and engaging them. Accordingly, there is obtained an advantage that the tab terminals 42 and 51 are firmly fixed on the bottom wall of the box 2 without increasing sizes in the widths of the tab terminals 42 and 51 as in the prior art.

Further, though there have been described the embodiments in which the present invention is applied to a double pole-single throw switch, it is needless to say that the present invention can also be applied to various types of rocker switches such as a single pole-single throw switch, a double pole-double throw switch and the like, and that the same function and effects can be obtained. In addition, in the second embodiment, there has been illustrated a case that a rocker switch of rated current 10A type can be used as one of rated current 16A type without increasing the external sizes of its box. It goes without saying that the present invention can also be applied to a case in which a rocker switch having a predetermined rated current/voltage is constructed such that it can be used as another rocker switch having its rated current/voltage larger than the predetermined rated current/voltage without increasing the external sizes thereof, and that the same function and effects can be obtained.

As described above, according to the present invention, it is possible to mount or assemble the fixed contact piece and the movable contact piece support member in the box and to secure them simply and easily with accuracy and stability. In addition, engagement between each movable contact piece actuator of the operation button and the movable contact piece is in the rolling friction state. As a result, there can be obtained actual feeling that the operation button swings lightly and smoothly (without feeling a resistance thereto) as well as that the operation button has positively stopped at its switch-on position or switch-off position, and feeling in actuation of the operation button comes to much favorable or excellent. Furthermore, the quick swinging operation of the movable contact piece is made possible and the more stable reverse operation of the movable contact pieces is obtained, which results in lesser bounce time in throwing the movable contact piece to its switch-on position as well as smaller arc occurring in throwing the movable contact piece to its switch-off position. As a result, wear and tear of the contacts are further restrained and there can be provided the contacts the lifetime of which is much more longer.

While the present invention has been described with regard to the preferred embodiments shown by way of example, it will be apparent to those skilled in the art that various modifications, alterations, changes, and/or minor improvements of the embodiments described above can be made without departing from the spirit and the scope of the present invention. Accordingly, it should be understood that the present invention is not limited to the illustrated embodiments, and is intended to encompass all such modifications, alterations, changes, and/or minor improvements falling within the scope of the invention defined by the appended claims.

What is claimed is:

1. A rocker switch comprising:

a movable contact piece having a generally U-like shape, that is made of an elastic member;

a movable contact that is mounted on a portion of the movable contact piece near one end thereof;

a movable contact piece support member that comprises: a movable contact piece support for swingably supporting the movable contact piece; and a tab terminal hanging down from the movable contact piece support;

a pair of detents that is formed to project on the both side edges of the tab terminal of the movable contact piece support member in the direction of the width of the tab terminal at predetermined positions thereof;

a fixed contact piece that comprises: a fixed contact support on which a fixed contact is mounted; and a tab terminal hanging down from the fixed contact support;

a pair of detents that is formed to project on the both side edges of the tab terminal of the fixed contact piece in the direction of the width of the tab terminal at predetermined positions thereof;

a box that has its top opened and a slit formed through the bottom wall of the box, through which the tab terminal of the movable contact piece support member is pulled out toward the outside and a slit formed through the bottom wall of the box, through which the tab terminal of the fixed contact piece is pulled out toward the outside;

an operation button that comprises a movable contact piece actuator to be engaged with the movable contact piece and is swingably mounted to the opening portion of the box; and a recess that is formed on a portion of the movable contact piece near the other end thereof to extend in the direction of the width of the movable contact piece and has a generally circular arc-shape in section engaged with a generally circular arc-shaped tip in section of the movable contact piece actuator of the operation button, and wherein the movable contact piece support member is engaged and secured on the bottom wall of the box by forcedly bending a pair of the detent pieces of the tab terminal thereof outwardly in the direction of the width thereof and engaging them, the tab terminal being pulled out toward the outside through the corresponding slit formed through the bottom wall of the box;

the fixed contact piece is engaged and secured on the bottom wall of the box by forcedly bending a pair of the detent pieces of the tab terminal thereof outwardly in the direction of the width thereof and engaging them, the tab terminal being pulled out toward the outside through the corresponding slit formed through the bottom wall of the box;

the operation button is swingably mounted to the opening portion of the box in the state that the generally circular arc-shaped tip in section of the movable contact piece actuator is engaged with the recess of a generally circular arc-shape in section of the movable contact piece; and the movable contact piece actuator that is swingable with the swinging movement of the operation button causes the movable contact piece to be swung to the switch-on position where the movable contact thereof comes into contact with the fixed contact or the switch-off position where the movable contact thereof is away from the fixed contact.

2. The rocker switch as set forth in claim 1, wherein the operation button further includes a rod-like member projecting beyond the tip of the movable contact piece actuator;

the movable contact piece has an elongate aperture at a portion thereof near the recess, into which the forward end of the rod-like member of the operation button is inserted with a clearance or play therebetween; and the forward end of the rod-like member is inserted into the elongate aperture with a clearance or play therebetween when the operation button is swingably mounted to the opening portion of the box.

3. The rocker switch as set forth in claim 2, further including a conductive resilient piece that is swingably mounted on the movable contact piece support member, and wherein the conductive resilient piece is located, when the movable contact piece is swingably mounted on the movable contact piece support member, between the movable contact piece and the movable contact piece support member and is in electrically contact with both the movable contact piece support member and the movable contact piece.

4. The rocker switch as set forth in claim 3, wherein the conductive resilient piece comprises: a sheet-like resilient piece body; a pair of opposed retentive pieces that substantially stand erect from the resilient piece body; and at least one pair of opposed protrusions that project outwardly and upwardly from the resilient piece body in the direction of forming generally right angles with a line connecting the retentive pieces, and a pair of the retentive pieces is pressed and abutted against the movable contact piece support member when the movable contact piece is swingably mounted on the movable contact piece support member, and at least one pair of the protrusions is pressed and abutted against the movable contact piece when the movable contact piece is swingably mounted on the movable contact piece support member through the resilient piece therebetween.

5. The rocker switch as set forth in claim 1, wherein the box has a generally rectangular or square shape in plan, a partition wall that isolates the tab terminal of the movable contact piece support member and the tab terminal of the fixed contact piece from each other, is formed on the bottom surface of the bottom wall of the box, the length of the partition wall is set to be substantially equal to those of the tab terminals, and the slits are formed obliquely in the bottom wall of the box from the vicinities of the corners thereof to form a predetermined angle with one side of the bottom wall respectively.

6. The rocker switch as set forth in claim 2, wherein the box has a generally rectangular or square shape in plan, a partition wall that isolates the tab terminal of the movable contact piece support member and the tab terminal of the fixed contact piece from each other, is formed on the bottom surface of the bottom wall of the box, the length of the partition wall is set to be substantially equal to those of the tab terminals, and the slits are formed obliquely in the bottom wall of the box from the vicinities of the corners thereof to form a predetermined angle with one side of the bottom wall respectively.

7. The rocker switch as set forth in claim 6, further including a conductive resilient piece that is swingably mounted on the movable contact piece support member, and wherein the conductive resilient piece is located, when the movable contact piece is swingably mounted on the movable contact piece support member, between the movable contact piece and the movable contact piece support member and is in electrically contact with both the movable contact piece support member and the movable contact piece.

8. The rocker switch as set forth in claim 7, wherein the conductive resilient piece comprises: a sheet-like resilient piece body; a pair of opposed retentive pieces that substantially stand erect from the resilient piece body; and at least one pair of opposed protrusions that project outwardly and upwardly from the resilient piece body in the direction of forming generally right angles with a line connecting the retentive pieces, and a pair of the retentive pieces is pressed and abutted against the movable contact piece support member when the movable contact piece is swingably mounted on the movable contact piece support member, and at least one pair of the protrusions is pressed and abutted against the movable contact piece when the movable contact piece is swingably mounted on the movable contact piece support member through the resilient piece therebetween.

9. The rocker switch as set forth in claim 5, further including a conductive resilient piece that is swingably mounted on the movable contact piece support member, and wherein the conductive resilient piece is located, when the movable contact piece is swingably mounted on the movable contact piece support member, between the movable contact piece and the movable contact piece support member and is in electrically contact with both the movable contact piece support member and the movable contact piece.

10. The rocker switch as set forth in claim 9, wherein the conductive resilient piece comprises: a sheet-like resilient piece body; a pair of opposed retentive pieces that substantially stand erect from the resilient piece body; and at least one pair of opposed protrusions that project outwardly and upwardly from the resilient piece body in the direction of forming generally right angles with a line connecting the retentive pieces, and a pair of the retentive pieces is pressed and abutted against the movable contact piece support member when the movable contact piece is swingably mounted on the movable contact piece support member, and at least one pair of the protrusions is pressed and abutted against the movable contact piece when the movable contact piece is swingably mounted on the movable contact piece support member through the resilient piece therebetween.

11. The rocker switch as set forth in claim 1, further including a conductive resilient piece that is swingably mounted on the movable contact piece support member, and wherein the conductive resilient piece is located, when the movable contact piece is swingably mounted on the movable contact piece support member, between the movable contact piece and the movable contact piece support member and is in electrically contact with both the movable contact piece support member and the movable contact piece.

12. The rocker switch as set forth in claim 11, wherein the conductive resilient piece comprises: a sheet-like resilient piece body; a pair of opposed retentive pieces that substantially stand erect from the resilient piece body; and at least one pair of opposed protrusions that project outwardly and upwardly from the resilient piece body in the direction of forming generally right angles with a line connecting the retentive pieces, and a pair of the retentive pieces is pressed and abutted against the movable contact piece support member when the movable contact piece is swingably mounted on the movable contact piece support member, and at least one pair of the protrusions is pressed and abutted against the movable contact piece when the movable contact piece is swingably mounted on the movable contact piece support member through the resilient piece therebetween.

* * * * *